US011409228B2

(12) United States Patent
Yamaguchi et al.

(10) Patent No.: US 11,409,228 B2
(45) Date of Patent: Aug. 9, 2022

(54) IMAGE FORMING APPARATUS CONFIGURED TO DETERMINE POSITION OF CAM BASED ON DETECTION RESULT OF SENSOR

(71) Applicant: BROTHER KOGYO KABUSHIKI KAISHA, Nagoya (JP)

(72) Inventors: Wataru Yamaguchi, Nisshin (JP); Yohei Hashimoto, Nagakute (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/336,511

(22) Filed: Jun. 2, 2021

(65) Prior Publication Data

US 2021/0382432 A1 Dec. 9, 2021

(30) Foreign Application Priority Data

Jun. 9, 2020 (JP) ..... JP2020-100106

(51) Int. Cl.
*G03G 21/16* (2006.01)
*G03G 21/18* (2006.01)

(52) U.S. Cl.
CPC ..... *G03G 21/1647* (2013.01); *G03G 21/1821* (2013.01); *G03G 21/1842* (2013.01); *G03G 2221/1654* (2013.01)

(58) Field of Classification Search
CPC ..... G03G 21/1633; G03G 21/1647; G03G 21/1842; G03G 15/0194; G03G 15/50; G03G 21/1821; G03G 21/1853; G03G 2215/00616; G03G 2221/1654
See application file for complete search history.

(56) References Cited

U.S. PATENT DOCUMENTS

| | | | | |
|---|---|---|---|---|
| 2009/0214235 | A1 | 8/2009 | Hattori | |
| 2012/0251179 | A1 | 10/2012 | Suzuki et al. | |
| 2021/0011395 | A1* | 1/2021 | Itabashi | G03G 21/1647 |
| 2021/0200140 | A1* | 7/2021 | Sano | G03G 21/1633 |

FOREIGN PATENT DOCUMENTS

| | | | |
|---|---|---|---|
| JP | 2008-58629 | A | 3/2008 |
| JP | 2009-204838 | A | 9/2009 |
| JP | 2011-253082 | A | 12/2011 |
| JP | 2012-212075 | A | 11/2012 |

* cited by examiner

*Primary Examiner* — Sophia S Chen
(74) *Attorney, Agent, or Firm* — Merchant & Gould P.C.

(57) ABSTRACT

A cam transmits and blocks light emitted from a light emitting portion. The cam moves to: a first position at which first and second cartridges are attachable to and detachable from a housing; a second position at which a first development roller contacts a first photosensitive drum, the second position being a position at which the cam has moved in a first direction from the first position; and a third position at which the first development roller is separated from the first photosensitive drum and a second development roller is separated from a second photosensitive drum, the third position being a position at which the cam has moved in the first direction from the second position. During an initial operation, based on a detection result of the sensor, a controller determines which of the first position, the second position, and the third position the cam is located at.

18 Claims, 23 Drawing Sheets

IMAGE FORMING APPARATUS CONFIGURED TO DETERMINE POSITION OF CAM BASED ON DETECTION RESULT OF SENSOR

CROSS REFERENCE TO RELATED APPLICATIONS

This application claims priority from Japanese Patent Application No. 2020-100106 filed Jun. 9, 2020. The entire content of the priority application is incorporated herein by reference.

TECHNICAL FIELD

This disclosure relates to an image forming apparatus.

BACKGROUND

Conventionally, an image forming apparatus includes a first cartridge, a second cartridge, a sensor, a cam, and a controller. The first cartridge includes a first photosensitive drum and a first development roller. The second cartridge includes a second photosensitive drum and a second development roller. The cam is movable between a contact position and a separation position. In a state where the cam is located at the contact position, the cam causes the first photosensitive drum and the first development roller to contact each other, and causes the second photosensitive drum and the second development roller to contact each other. In a state where the cam is located at the separation position, the cam causes the first photosensitive drum and the first development roller to separate from each other and causes the second photosensitive drum and the second development roller to separate from each other. The sensor detects either one of the contact position and the separation position as the initial position of the cam. During the initial operation of the image forming apparatus, the controller determines whether the cam is located at the initial position based on the detection result of the sensor, and if the cam is not located at the initial position, moves the cam to the initial position.

SUMMARY

According to one aspect, this specification discloses an image forming apparatus. The image forming apparatus includes a housing, a first cartridge, a second cartridge, a sensor, a cam, and a controller. The housing has an opening. The first cartridge is attachable to and detachable from the housing through the opening. The first cartridge includes a first photosensitive drum and a first development roller. The second cartridge is attachable to and detachable from the housing through the opening. The second cartridge includes a second photosensitive drum and a second development roller. The sensor includes a light emitting portion and a light receiving portion. The light receiving portion is configured to receive light from the light emitting portion. The sensor is configured to detect reception of light by the light receiving portion. The cam is configured to transmit and block light emitted from the light emitting portion. The cam is movable to: a first position at which the first cartridge and the second cartridge are attachable to and detachable from the housing; a second position at which the first development roller contacts the first photosensitive drum, the second position being a position at which the cam has moved in a first direction from the first position; and a third position at which the first development roller is separated from the first photosensitive drum and the second development roller is separated from the second photosensitive drum, the third position being a position at which the cam has moved in the first direction from the second position. The controller is configured to, during an initial operation, based on a detection result of the sensor, determine which of the first position, the second position, and the third position the cam is located at.

According to another aspect, this specification discloses an image forming apparatus. The image forming apparatus includes a housing, a first cartridge, a second cartridge, a sensor, and a cam. The housing has an opening. The first cartridge is attachable to and detachable from the housing through the opening. The first cartridge includes a first photosensitive drum and a first development roller. The second cartridge is attachable to and detachable from the housing through the opening. The second cartridge includes a second photosensitive drum and a second development roller. The sensor includes a light emitting portion and a light receiving portion. The light receiving portion is configured to receive light from the light emitting portion. The sensor is configured to detect reception of light by the light receiving portion. The cam is configured to transmit and block light emitted from the light emitting portion. The cam is movable to: a first position at which the first cartridge and the second cartridge are attachable to and detachable from the housing; a second position at which the first development roller contacts the first photosensitive drum, the second position being a position at which the cam has moved in a first direction from the first position; and a third position at which the first development roller is separated from the first photosensitive drum and the second development roller is separated from the second photosensitive drum, the third position being a position at which the cam has moved in the first direction from the second position. The cam has one end and an other end in a movement direction of the cam. The cam includes a light transmitting portion configured to transmit light emitted from the light emitting portion. The light transmitting portion is located between the one end and the other end in the movement direction.

BRIEF DESCRIPTION OF THE DRAWINGS

Embodiments in accordance with this disclosure will be described in detail with reference to the following figures wherein.

DETAILED DESCRIPTION

In the image forming apparatus described above, immediately after the initial operation, the cam is located at an initial position, which is one of the contact position and the separation position. After that, the controller causes the cam to move from the initial position to the other one of the contact position and the separation position, if necessary.

For example, in a case where the initial position of the cam is the separation position and printing is started after the initial operation, even if the cam is located at the contact position at the time of the initial operation, the cam once moves from the contact position to the separation position, and thereafter the cam returns from the separation position to the contact position. As a result, it is difficult to reduce the time for locating the cam at a desired position.

In view of the foregoing, an aspect of an objective of this disclosure is to provide an image forming apparatus configured to detect at which position of a first position, a second position, and a third position the cam is located and to cause the cam to be smoothly located at a desired position.

1. Image Forming Apparatus 1

An image forming apparatus 1 will be described with reference to FIG. 1.

Figure 1:
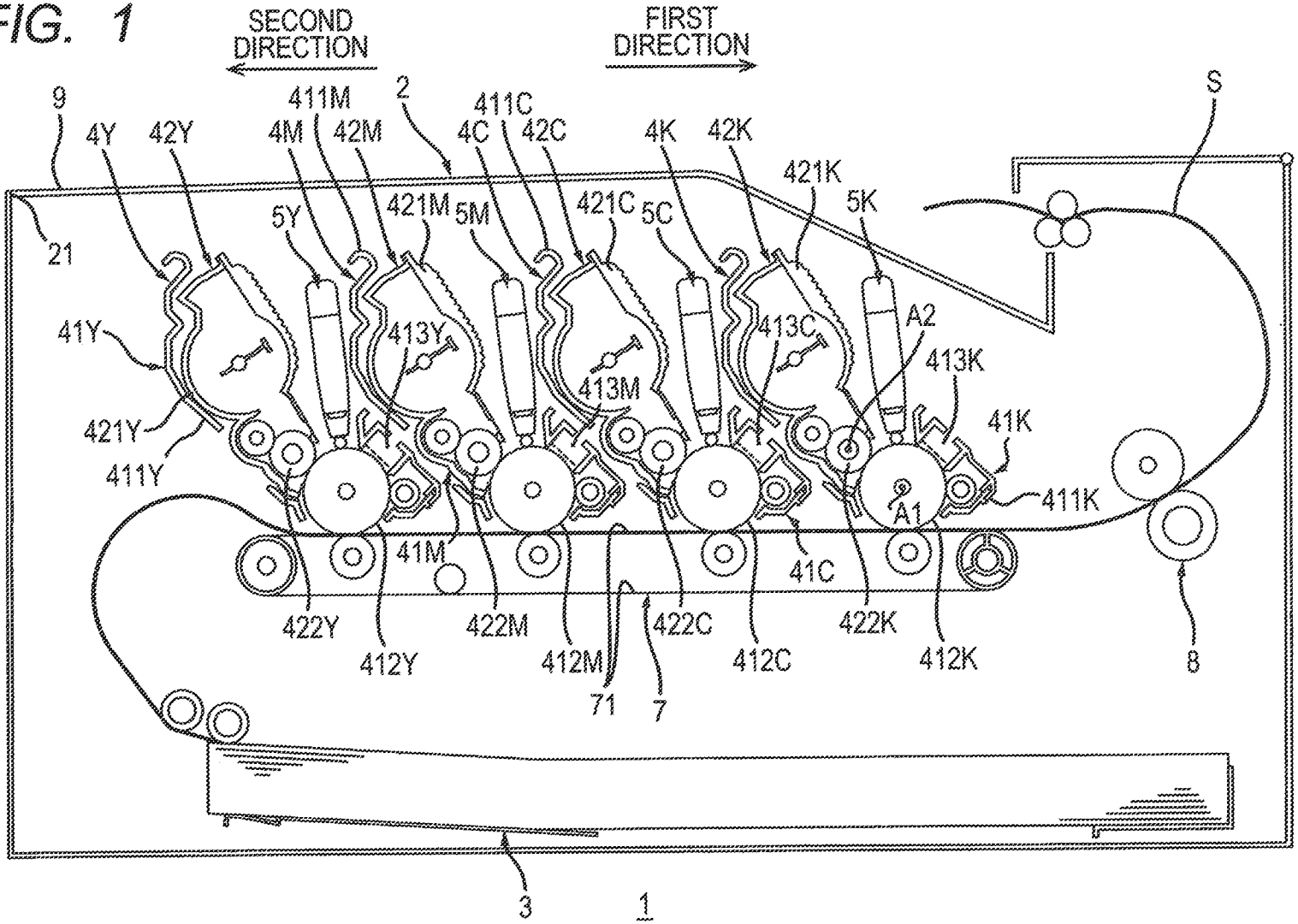
FIG. 1 is a schematic diagram showing the configuration of an image forming apparatus in a state where a cover is located at a closed position.
Figure 2:
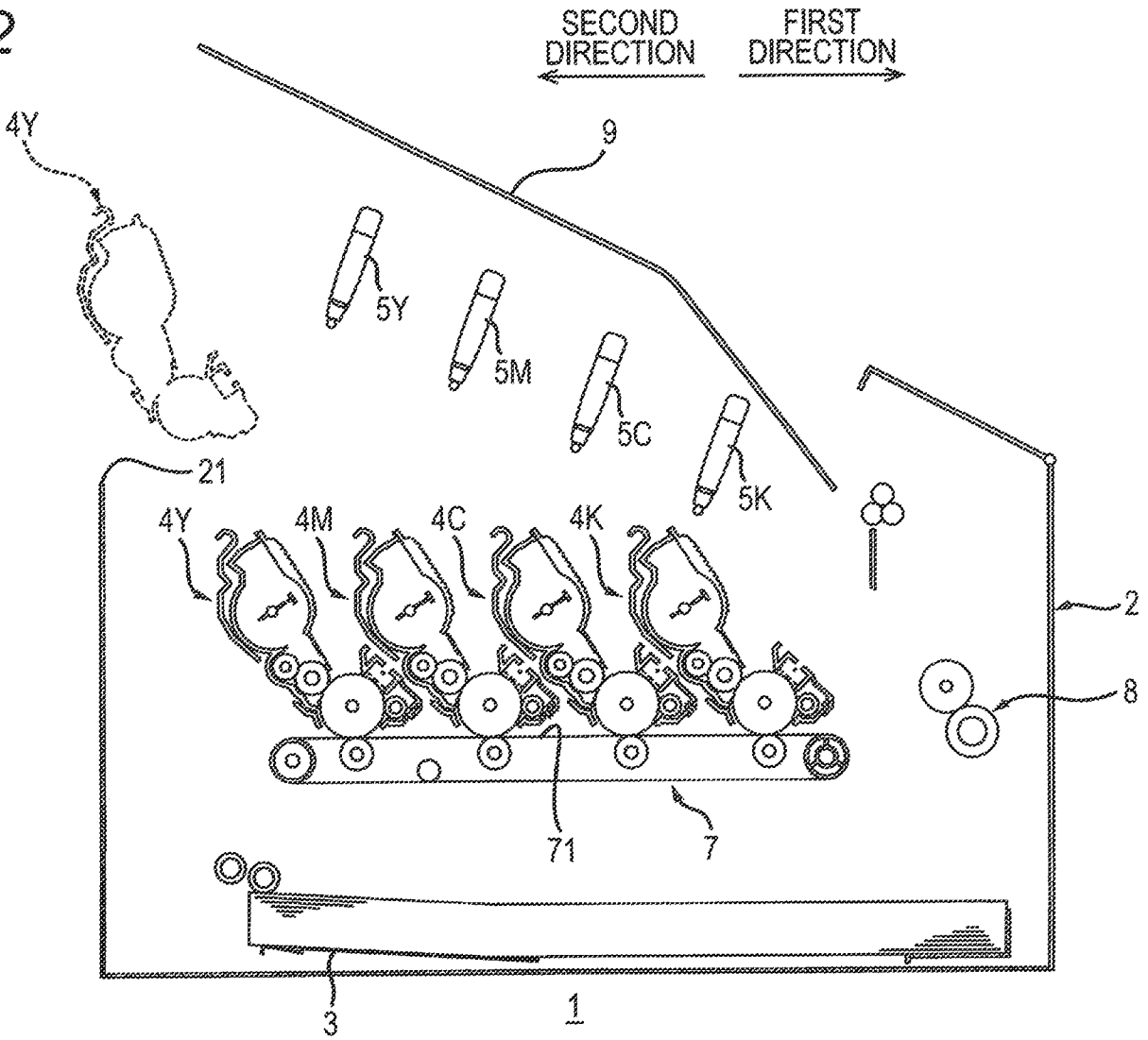
FIG. 2 is a schematic diagram showing the configuration of the image forming apparatus shown in FIG. 1 in a state where the cover is located at an open position.

As shown in FIGS. 1 and 2, the image forming apparatus 1 includes a housing 2, a cover 9, a sheet cassette 3, four cartridges 4Y, 4M, 4C, 4K, and four exposure devices 5Y, 5M, 5C, 5K, a transfer device 7, and a fixing device 8.

1.1 Housing 2

The housing 2 accommodates the sheet cassette 3, the four cartridges 4Y, 4M, 4C, 4K, the four exposure devices 5Y, 5M, 5C, 5K, the transfer device 7, and the fixing device 8.

The housing 2 has an opening 21. The opening 21 is located at the upper end of the housing 2.

1.2 Cover 9

A cover 9 opens and closes the opening 21. The cover 9 is movable between an open position (see FIG. 2) and a closed position (see FIG. 1). In a state where the cover 9 is located at the open position, the opening 21 opens. In a state where the cover 9 is located at the closed position, the cover 9 closes the opening 21.

1.3 Sheet Cassette 3

The sheet cassette 3 accommodates a sheet S. The sheet S in the sheet cassette 3 is conveyed toward a photosensitive drum 412Y. The photosensitive drum 412Y will be described later.

1.4 Four Cartridges 4Y, 4M, 4C, 4K

The four cartridges 4Y, 4M, 4C, 4K are arranged in a first direction. The first direction is along a conveyance direction of the sheet S by a conveyance belt 71. The conveyance belt 71 will be described later. The reverse direction of the first direction is a second direction. The four cartridges 4Y, 4M, 4C, and 4K are arranged in this order in the first direction. As shown in FIG. 2, in a state where the cover 9 is located at the open position, each of the four cartridges 4Y, 4M, 4C, and 4K is attachable to and detachable from the housing 2 through the opening 21.

1.4.1 Cartridge 4K

As shown in FIG. 1, the cartridge 4K includes a drum cartridge 41K and a development cartridge 42K.

1.4.1.1 Drum Cartridge 41K

The drum cartridge 41K includes a drum frame 411K, a photosensitive drum 412K, and a charging device 413K.

The drum frame 411K supports the photosensitive drum 412K and the charging device 413K.

The photosensitive drum 412K extends in a third direction. The third direction intersects the first direction. The third direction intersects the vertical direction. The vertical direction is the gravitational direction when the image forming apparatus 1 is placed in a normal use state. The photosensitive drum 412K has a cylindrical shape. The photosensitive drum 412K is rotatable about a rotation axis A1. The rotation axis A1 extends in the third direction.

The charging device 413K charges the circumferential surface of the photosensitive drum 412K. Specifically, the charging device 413K is a scorotron charger. The charging device 413K may be a charging roller.

1.4.1.2 Development Cartridge 42K

The development cartridge 42K includes a development frame 421K and a development roller 422K. In other words, the cartridge 4K includes the drum frame 411K, the photosensitive drum 412K, the charging device 413K, the development frame 421K, and the development roller 422K.

The development frame 421K contains toner. The development frame 421K supports the development roller 422K.

The development roller 422K extends in the third direction. The development roller 422K is rotatable about a rotation axis A2. The rotation axis A2 extends in the third direction.

The development cartridge 42K is attachable to and detachable from the drum frame 411K of the drum cartridge 41K. Thus, the development cartridge 42K having the development roller 422K and the drum cartridge 41K having the photosensitive drum 412K can be exchanged individually.

Figure 3A:
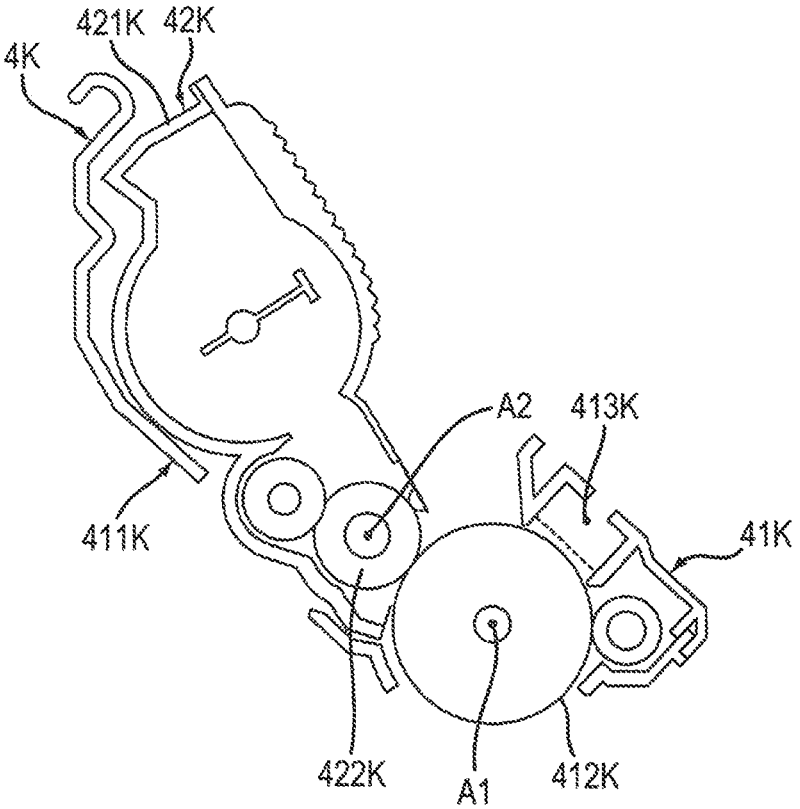
FIG. 3A is a schematic diagram showing the configuration of a cartridge shown in FIG. 1, and showing a state where the development cartridge is located at a contact position.
Figure 3B:
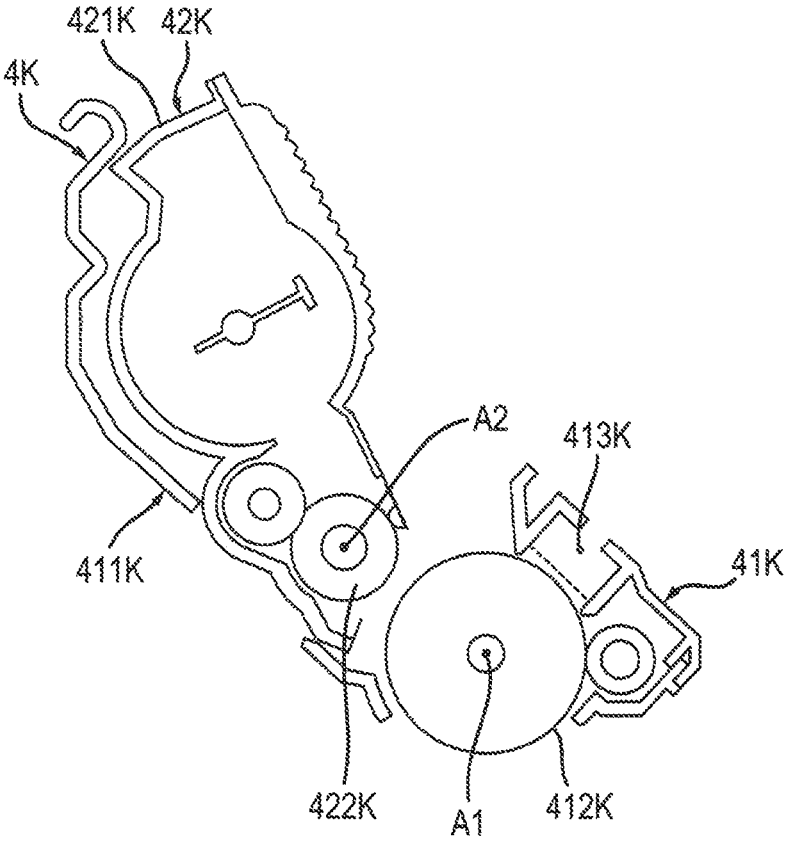
FIG. 3B is a schematic diagram showing the configuration of the cartridge shown in FIG. 1, and showing a state where the development cartridge is located at a separation position.

As shown in FIGS. 3A and 3B, in a state where the development cartridge 42K is mounted on the drum frame 411K, the development cartridge 42K is movable between a contact position (see FIG. 3A) and a separation position (see FIG. 3B). In a state where the development cartridge 42K is located at the contact position, the development roller 422K contacts the photosensitive drum 412K. In a state where the development cartridge 42K is located at the contact position, the development roller 422K supplies toner to the photosensitive drum 412K. In a state where the development cartridge 42K is located at the separation position, the development roller 422K is separated from the photosensitive drum 412K.

1.4.2 Cartridge 4Y, 4M, 4C

As shown in FIG. 1, the cartridges 4Y, 4M, and 4C are described in the same manner as the cartridge 4K. Thus, the description of the cartridges 4Y, 4M, and 4C will be omitted.

The cartridge 4Y includes a drum cartridge 41Y and a development cartridge 42Y. The drum cartridge 41Y includes a drum frame 411Y, a photosensitive drum 412Y, and a charging device 413Y. The development cartridge 42Y includes a development frame 421Y and a development roller 422Y.

The cartridge 4M includes a drum cartridge 41M and a development cartridge 42M. The drum cartridge 41M includes a drum frame 411M, a photosensitive drum 412M, and a charging device 413M. The development cartridge 42M includes a development frame 421M and a development roller 422M.

The cartridge 4C includes a drum cartridge 41C and a development cartridge 42C. The drum cartridge 41C includes a drum frame 411C, a photosensitive drum 412C, and a charging device 413C. The development cartridge 42C includes a development frame 421C and a development roller 422C.

In other words, each of the cartridges 4Y, 4M, and 4C includes a drum frame 411, a photosensitive drum 412, a charging device 413, a development frame 421, and a development roller 422.

1.5. Four Exposure Devices 5Y, 5M, 5C, 5K

Four exposure devices 5Y, 5M, 5C, and 5K are supported by the cover 9. In a state where the cover 9 is located at the closed position, the four exposure devices 5Y, 5M, 5C, and 5K are located in the housing 2. In a state where the cover 9 is located at the open position, the four exposure devices 5Y, 5M, 5C, and 5K are located outside the housing 2 (see FIG. 2).

1.5.1 Exposure Device 5K

In a state where the cover 9 is located at the closed position, the exposure device 5K exposes the surface of the photosensitive drum 412K. When the exposure device 5K exposes the surface of the photosensitive drum 412K in a state where the surface of the photosensitive drum 412K is charged, an electrostatic latent image is formed on the surface of the photosensitive drum 412K. Specifically, the exposure device 5K is an LED array.

1.5.2 Exposure Devices 5Y, 5M, 5C

The exposure devices 5Y, 5M, 5C are described in the same manner as the exposure device 5K. Thus, the description of the exposure devices 5Y, 5M, 5C will be omitted. The exposure device 5Y exposes the surface of the photosensitive drum 412Y. The exposure device 5M exposes the surface of the photosensitive drum 412M. The exposure device 5C exposes the surface of the photosensitive drum 412C.

1.6 Transfer Device 7

The transfer device 7 includes the conveyance belt 71. The conveyance belt 71 conveys the sheet S supplied from the sheet cassette 3 toward the fixing device 8. The sheet S conveyed by the conveyance belt 71 passes between the transfer device 7 and the four photosensitive drums 412Y, 412M, 412C, and 412K. At this time, the transfer device 7 transfers the toner on the four photosensitive drums 412Y, 412M, 412C, and 412K to the sheet S.

1.7 Fixing Device 8

The fixing device 8 heats and pressurizes the sheet S on which the toner is transferred to fix the toner on the sheet S. The sheet S that has passed through the fixing device 8 is discharged onto the upper surface of the housing 2.

2. Details of Drum Cartridge 41K

Next, the details of the drum cartridge 41K will be described with reference to FIGS. 4 to 7. The drum cartridge 41Y, 41M, and 41C are described in the same manner as the drum cartridge 41K. Thus, the detailed descriptions of the drum cartridge 41Y, 41M, and 41C are omitted.

Figure 4:
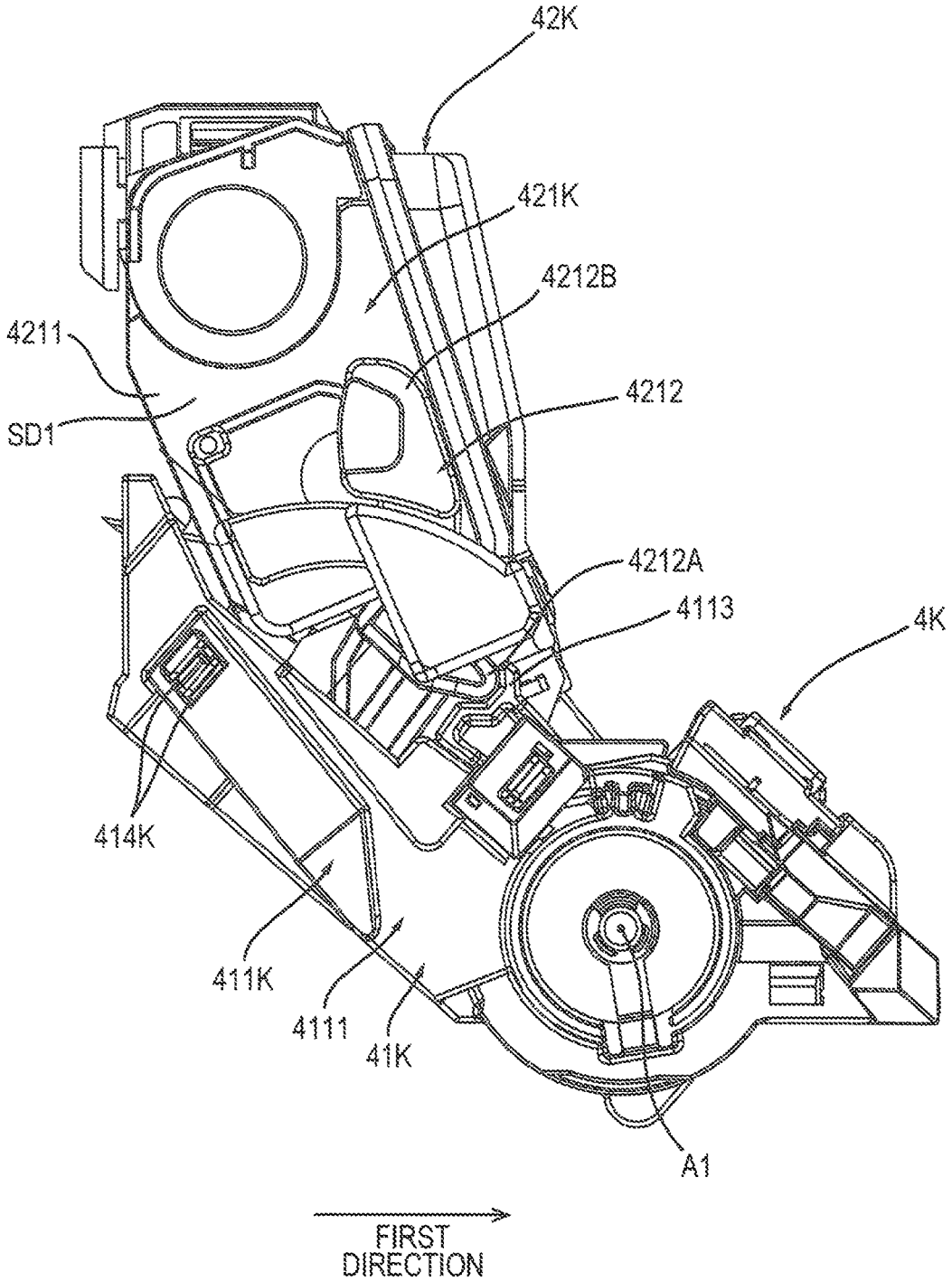
FIG. 4 is a side view of the cartridge shown in FIG. 3A, as viewed from one side.
Figure 5:
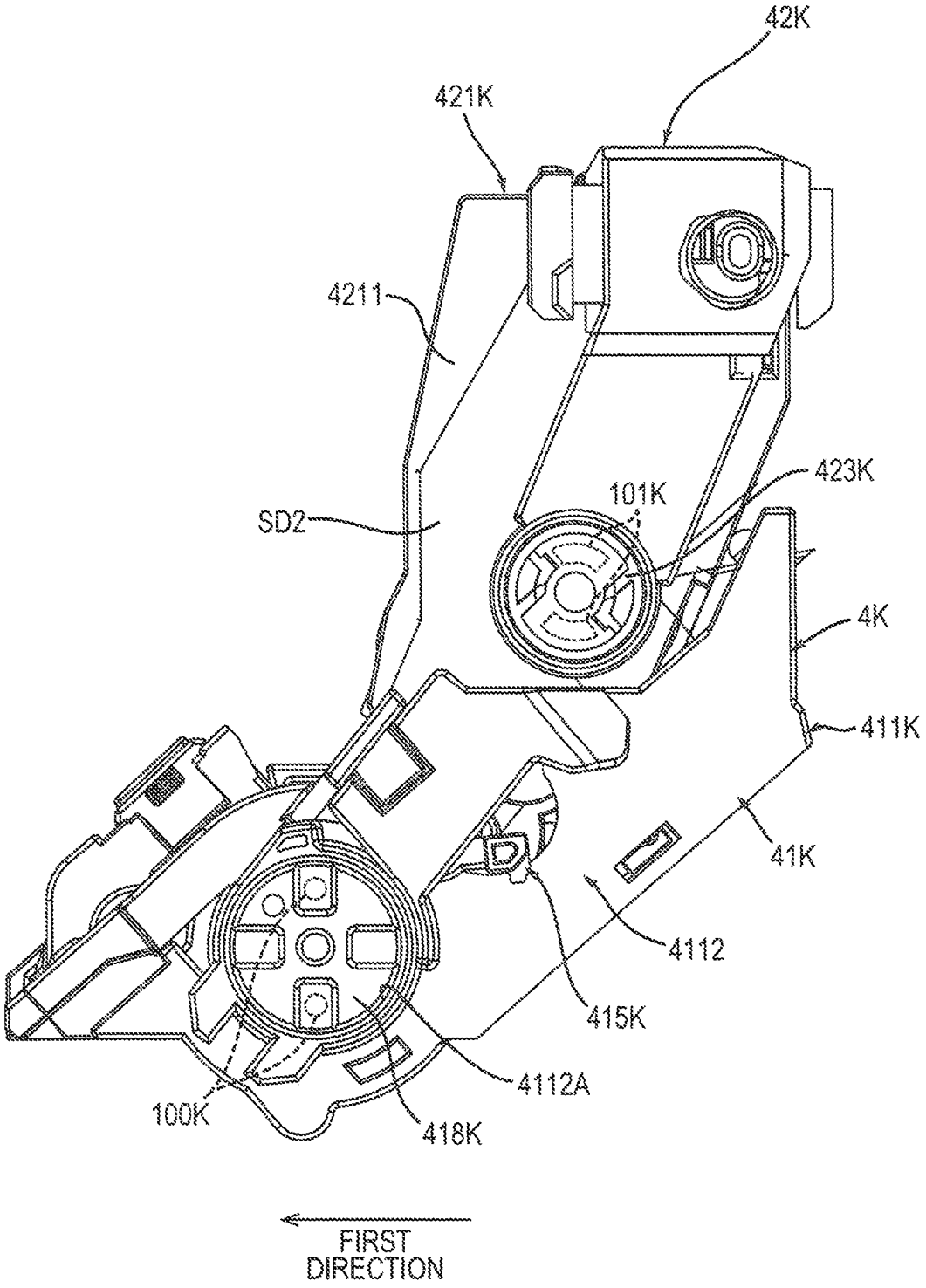
FIG. 5 is a side view the cartridge shown in FIG. 3A, as viewed from the other side.
Figure 6:
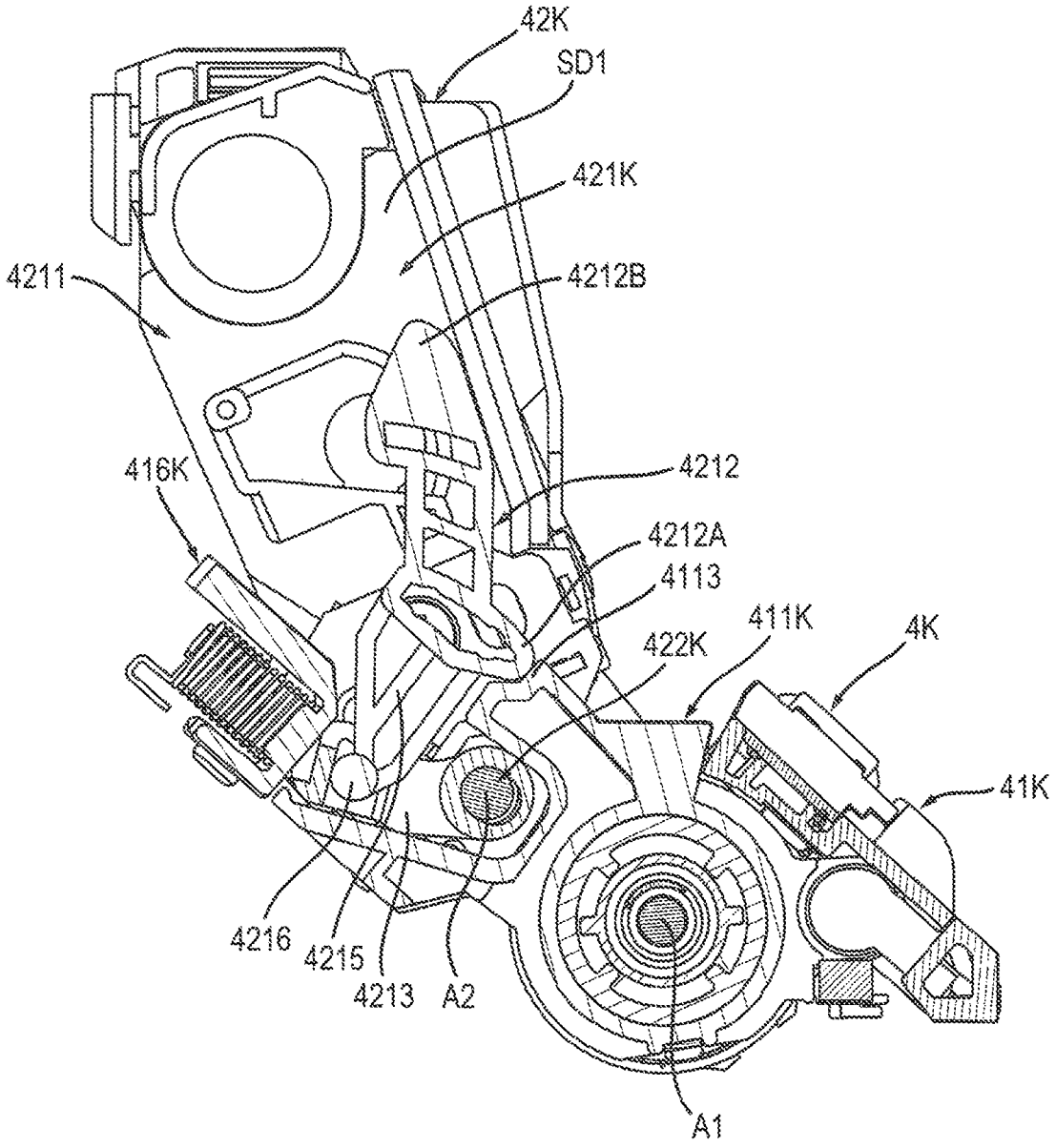
FIG. 6 is a side cross-sectional view of a first side wall and a second contact portion shown in FIG. 4, and shows a state where a development cartridge is located at the contact position.
Figure 7:
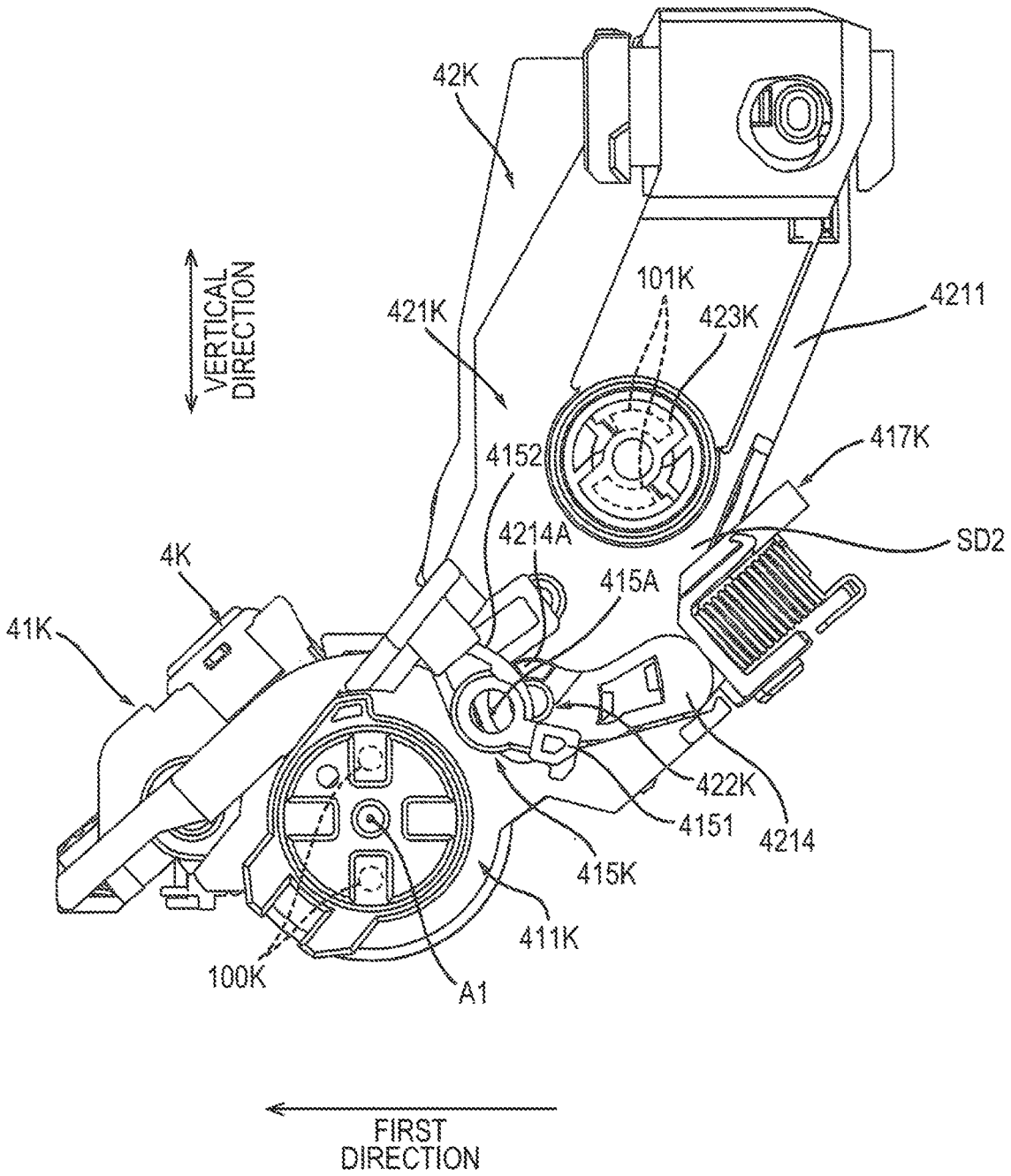
FIG. 7 is a side view of a rotating member and a second support portion shown in FIG. 5, and shows a state where the development cartridge is located at the contact position.

As shown in FIGS. 4 to 7, in addition to the above-mentioned drum frame 411K, photosensitive drum 412K, and charging device 413K, the drum cartridge 41K includes a development electrode 414K (see FIG. 4), a drum coupling 418K (see FIG. 5), a rotating member 415K (see FIG. 5), and two pressing members 416K and 417K (see FIGS. 6 and 7).

2.1 Drum Frame 411K

As shown in FIGS. 4 and 5, the drum frame 411K includes a first side wall 4111 (see FIG. 4) and a second side wall 4112 (see FIG. 5). The first side wall 4111 is located at one end of the drum frame 411K in the third direction. The second side wall 4112 is located at the other end of the drum frame 411K in the third direction. The first side wall 4111 supports one end of the photosensitive drum 412K (see FIG. 3A) in the third direction. The second side wall 4112 supports the other end of the photosensitive drum 412K in the third direction.

2.1.1 First Side Wall 4111

As shown in FIG. 4, the first side wall 4111 includes a first contact portion 4113. In a state where the development cartridge 42K is attached to the drum frame 411K, the first contact portion 4113 contacts a second contact portion 4212 of the development frame 421K. The second contact portion 4212 will be described later.

The first contact portion 4113 is located away from the rotation axis A1 of the photosensitive drum 412K in the radial direction of the photosensitive drum 412K. In a state where the cartridge 4K is located in the housing 2, the first contact portion 4113 is located above the rotation axis A1.

2.1.2 Second Side Wall 4112

As shown in FIG. 5, the second side wall 4112 is located away from the first side wall 4111 in the third direction. The second side wall 4112 has a hole 4112A.

2.2 Development Electrode 414K

As shown in FIG. 4, the development electrode 414K is provided at the first side wall 4111. In a state where the development cartridge 42K is attached to the drum frame 411K, the development electrode 414K is electrically connected to the development roller 422K (see FIG. 3A).

In a state where the cartridge 4K is located in the housing 2, the development electrode 414K is in contact with an electrode (not shown) of the image forming apparatus 1. The electrode contacts the development electrode 414K in the third direction from the opposite side of the second side wall 4112 (see FIG. 5). The electrode presses the drum cartridge 41K in the third direction in a state where the electrode is in contact with the development electrode 414K. With this configuration, the drum cartridge 41K is positioned relative to the housing 2 in the third direction.

2.3 Drum Coupling 418K

As shown in FIG. 5, the drum coupling 418K is attached to the other end of the photosensitive drum 412K (see FIG. 3A) in the third direction. The drum coupling 418K is rotatable with the photosensitive drum 412K. The drum coupling 418K is fitted into the hole 4112A. Thereby, the other end of the photosensitive drum 412K in the third direction is rotatably supported by the second side wall 4112 through the drum coupling 418K.

A first input portion 100K provided at the image forming apparatus 1 is fitted in the drum coupling 418K. The first input portion 100K inputs a driving force to the photosensitive drum 412K. In a state where the first input portion 100K is fitted in the drum coupling 418K, the drum coupling 418K is rotatable with the first input portion 100K. As a result, the drum coupling 418K receives the driving force from the first input portion 100K to cause the photosensitive drum 412K to rotate. The first input portion 100K is movable in the third direction.

Although not shown, the image forming apparatus 1 further includes three first input portions 100Y, 100M, and 100C. The three first input portions 100Y, 100M and 100C are described in the same manner as the first input portion 100K. Thus, the description of the three first input portions 100Y, 100M, and 100C will be omitted. The first input portion 100Y inputs a driving force to the photosensitive drum 412Y. The first input portion 100Y fits into a drum coupling 418Y of the drum cartridge 41Y. The first input portion 100M inputs a driving force to the photosensitive drum 412M. The first input portion 100M fits into a drum coupling 418M of the drum cartridge 41M. The first input portion 100C inputs a driving force to the photosensitive drum 412C. The first input portion 100C fits into a drum coupling 418C of the drum cartridge 41C.

2.4 Rotating Member 415K

As shown in FIG. 7, the rotating member 415K is supported by the second side wall 4112. The rotating member 415K is rotatable about an axis 415A. The axis 415A extends in the third direction. The rotating member 415K has a third contact portion 4151 and a fourth contact portion 4152. In a state where the cartridge 4K is located in the housing 2, the third contact portion 4151 is configured to contact the lever 19K. The lever 19K will be described later. The fourth contact portion 4152 is located at the opposite side of the third contact portion 4151 with respect to the axis 415A. In a state where the third contact portion 4151 is in contact with the lever 19Y, the fourth contact portion 4152 contacts a protrusion 4214A provided at the development frame 421K. The protrusion 4214A will be described later. Similarly, the drum cartridge 41Y includes a rotating member 415Y, the drum cartridge 41M includes a rotating member 415M, and the drum cartridge 41C includes a rotating member 415C (see FIG. 16).

2.5 Pressing Members 416K, 417K

As shown in FIGS. 6 and 7, in a state where the development cartridge 42K is attached to the drum frame 411K, the two pressing members 416K and 417K press the development frame 421K toward the contact position (see FIG. 3A). The two pressing members 416K and 417K are supported by the drum frame 411K. The two pressing members 416K and 417Y are located away from each other in the third direction.

3. Details of Development Cartridge 42K

Next, the details of the development cartridge 42K will be described with reference to FIGS. 4 to 7. The development cartridges 42Y, 42M, and 42C are described in the same manner as the development cartridge 42K. Thus, detailed description of the development cartridges 42Y, 42M, and 42C will be omitted.

As shown in FIGS. 4 and 5, the development cartridge 42K extends in the third direction. The development cartridge 42K has a first side surface SD1 and a second side surface SD2 in the third direction. The first side surface SD1 is located at one end of the development cartridge 42K in the third direction. The second side surface SD2 is located at the other end of the development cartridge 42K in the third direction.

The development cartridge 42K includes a development coupling 423K (see FIG. 5) in addition to the development frame 421K and the development roller 422K described above.

3.1 Development Frame 421K

As shown in FIG. 6 and FIG. 7, the development frame 421K includes a development housing 4211, a first support portion 4213 (see FIG. 6), a second contact portion 4212, a connection portion 4215, an engagement portion 4216 (see FIG. 6), and a second support portion 4214 (see FIG. 7).

The development housing 4211 contains toner. The development housing 4211 extends in the third direction. In a state where the development cartridge 42K is attached to the drum frame 411K, the development housing 4211 is located between the first side wall 4111 and the second side wall 4112 in the third direction.

As shown in FIG. 6, the first support portion 4213 supports one end of the development roller 422K (see FIG.

3A) in the third direction. The first support portion 4213 is located at the first side surface SD1. The first support portion 4213 is supported by the development housing 4211. In a state where the development cartridge 42K is attached to the drum frame 411K, the first support portion 4213 is located between the pressing member 416K and the rotation axis A1 of the photosensitive drum 412K. In a state where the development cartridge 42K is attached to the drum frame 411K, the first support portion 4213 contacts the pressing member 416K. Thus, the pressing member 416K presses the development cartridge 42K toward the contact position (see FIG. 3A).

The second contact portion 4212 is located at the first side surface SD1. The second contact portion 4212 is supported by the development housing 4211. In a state where the cartridge 4K is located in the housing 2, the second contact portion 4212 is located above the first support portion 4213. In a state where the development cartridge 42K is located in the housing 2, the second contact portion 4212 extends in the vertical direction. The second contact portion 4212 has a first portion 4212A and a second portion 4212B.

The first portion 4212A is located at one end of the second contact portion 4212. In a state where the development cartridge 42 K is attached to the drum frame 411K, the first portion 4212A contacts the first contact portion 4113. In a state where the development cartridge 42 K is attached to the drum frame 411K, the first portion 4212A is located at the opposite side of the rotation axis A1 of the photosensitive drum 412K with respect to the first contact portion 4113.

The second portion 4212B is located at the other end of the second contact portion 4212. In a state where the cartridge 4K is located in the housing 2, the second portion 4212B is located above and away from the first portion 4212A. In a state where the cartridge 4K is located in the housing 2, the second portion 4212B is configured to contact a protrusion 183 of the arm 18K. The protrusion 183 will be described later.

The engagement portion 4216 engages the first support portion 4213. The connection portion 4215 connects the second contact portion 4212 and the engagement portion 4216.

As shown in FIG. 7, the second support portion 4214 supports the other end of the development roller 422K (see FIG. 3A) in the third direction. The second support portion 4214 is located at the opposite side of the first support portion 4213 with respect to the development housing 4211 in the third direction. The second support portion 4214 is located at the second side surface SD2. The second support portion 4214 is supported by the development housing 4211. In a state where the development cartridge 42 K is attached to the drum frame 411K, the second support portion 4214 is located between the pressing member 417K and the rotation axis A1 of the photosensitive drum 412K. In a state where the development cartridge 42K is attached to the drum frame 411K, the second support portion 4214 contacts the pressing member 417K. Thus, the pressing member 417K presses the development cartridge 42K toward the contact position (see FIG. 3A).

The second support portion 4214 includes the protrusion 4214A. The protrusion 4214A extends in the third direction. In a state where the development cartridge 42K is attached to the drum frame 411K, the protrusion 4214A is located between the fourth contact portion 4152 and the pressing member 417K in the first direction.

3.2 Development coupling 423K

The development coupling 423K is provided at the second side surface SD2. The second input portion 101K provided at the image forming apparatus 1 is fitted in the development coupling 423K. The second input portion 101K inputs a driving force to the development roller 422K. In a state where the second input portion 101K is fitted in the development coupling 423K, the development coupling 423K is rotatable with the second input portion 101K. With this configuration, the development coupling 423K receives the driving force from the second input portion 101K to rotate the development roller 422K. The second input portion 101K is movable in the third direction.

Although not shown, the image forming apparatus 1 further includes three second input portions 101Y, 101M, and 101C. The three second input portions 101Y, 101M, and 101C are described in the same manner as the second input portion 101K. Thus, the description of the three second input portions 101Y, 101M, and 101C will be omitted. The second input portion 101Y inputs a driving force to the development roller 421Y. The second input portion 101Y fits into a development coupling 423Y provided at the development cartridge 42Y. The second input portion 101M inputs a driving force to the development roller 421M. The second input portion 101M fits into a development coupling 423M provided at the development cartridge 42M. The second input portion 101C inputs a driving force to the development roller 421C. The second input portion 101C fits into a development coupling 423C provided at the development cartridge 42C.

4. Details of Image Forming Apparatus

Next, the details of the image forming apparatus 1 will be described with reference to FIGS. 10 to 16.

Figure 10:
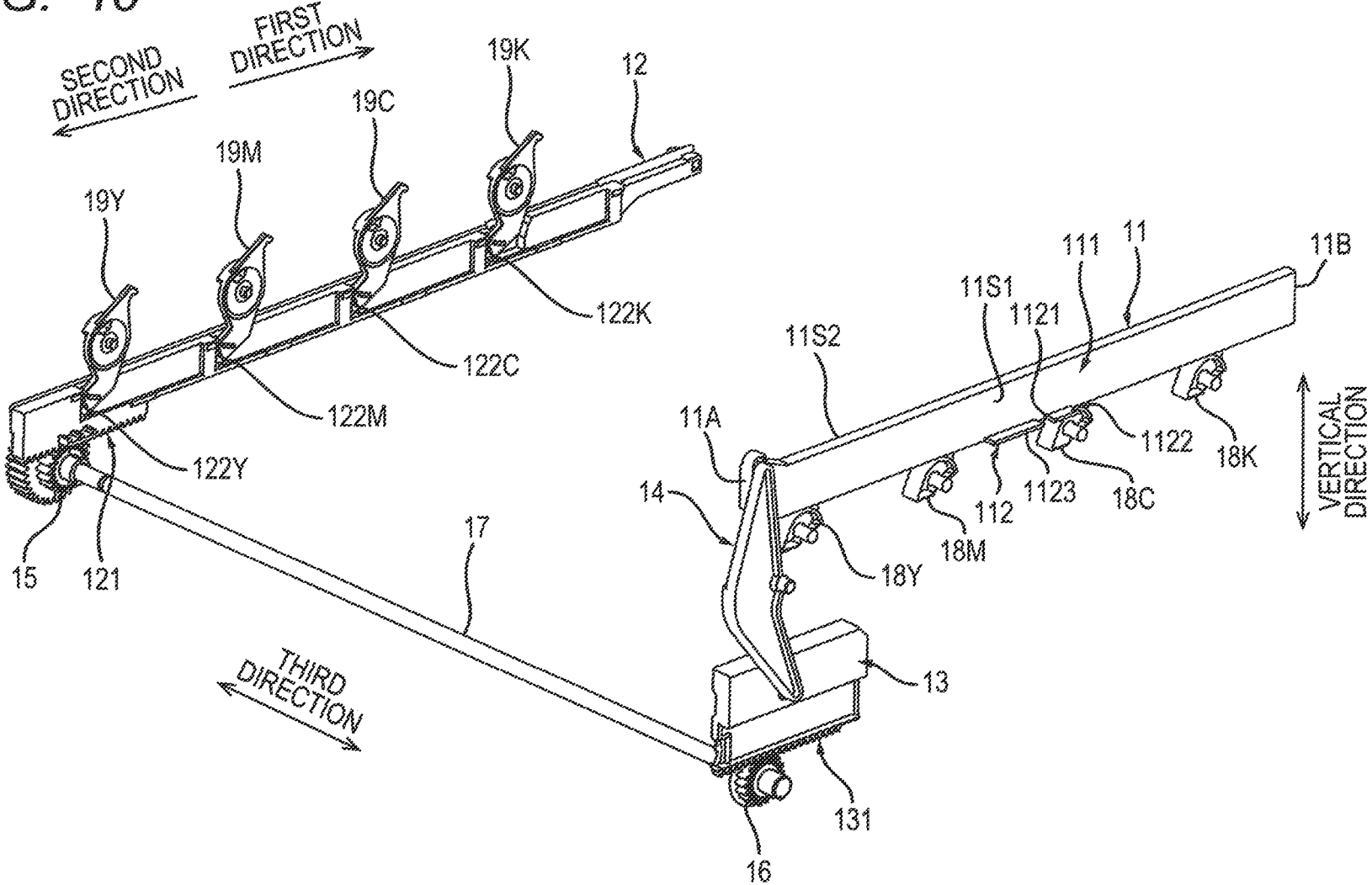
FIG. 10 is a perspective view of a first cam, a second cam, a link member, and a rotation rod included in the image forming apparatus shown in FIG. 1.
Figure 11:
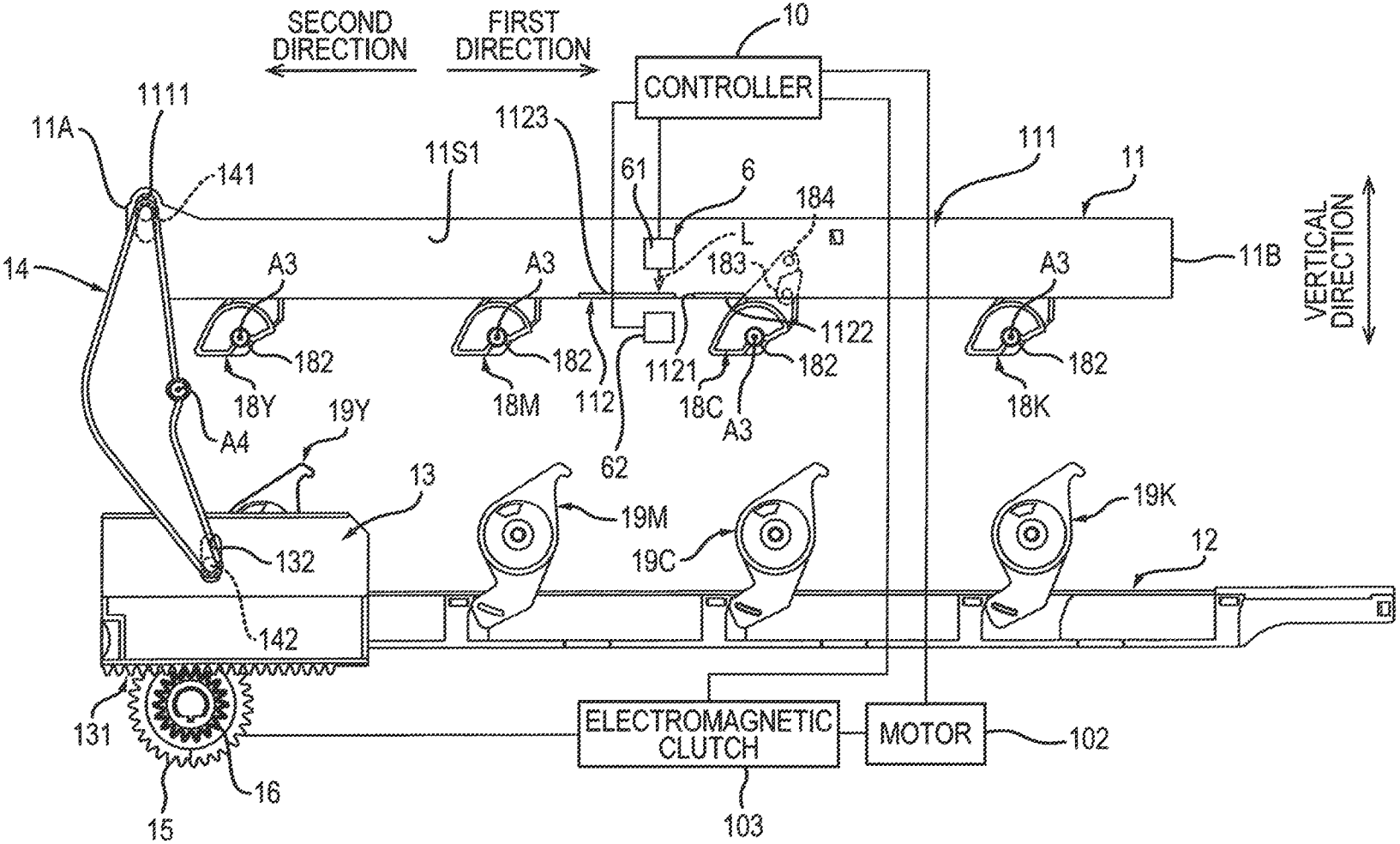
FIG. 11 is a side view of the first cam, the second cam, the link member, and the rotation rod shown in FIG. 10.

As shown in FIGS. 10 and 11, the image forming apparatus 1 includes a first cam 11, four arms 18Y, 18M, 18C, 18K, a second cam 12, four levers 19Y, 19M, 19C, 19K, a link member 13, a rotation rod 14, a first gear 15, a second gear 16, a shaft 17 (see FIG. 10), a motor 102 (see FIG. 11), an electromagnetic clutch 103 (see FIG. 11), a sensor 6 (see FIG. 11), and a controller 10 (see FIG. 11).

4.1 First Cam 11

As shown in FIG. 10, the first cam 11 extends in the first direction. The first cam 11 includes one end 11A in the first direction and an other end 11B in the first direction. The other end 11B of the first cam 11 is located away from the one end 11A in the first direction. The first cam 11 is arranged at a higher position than the second cam 12 in the vertical direction.

Figure 12:
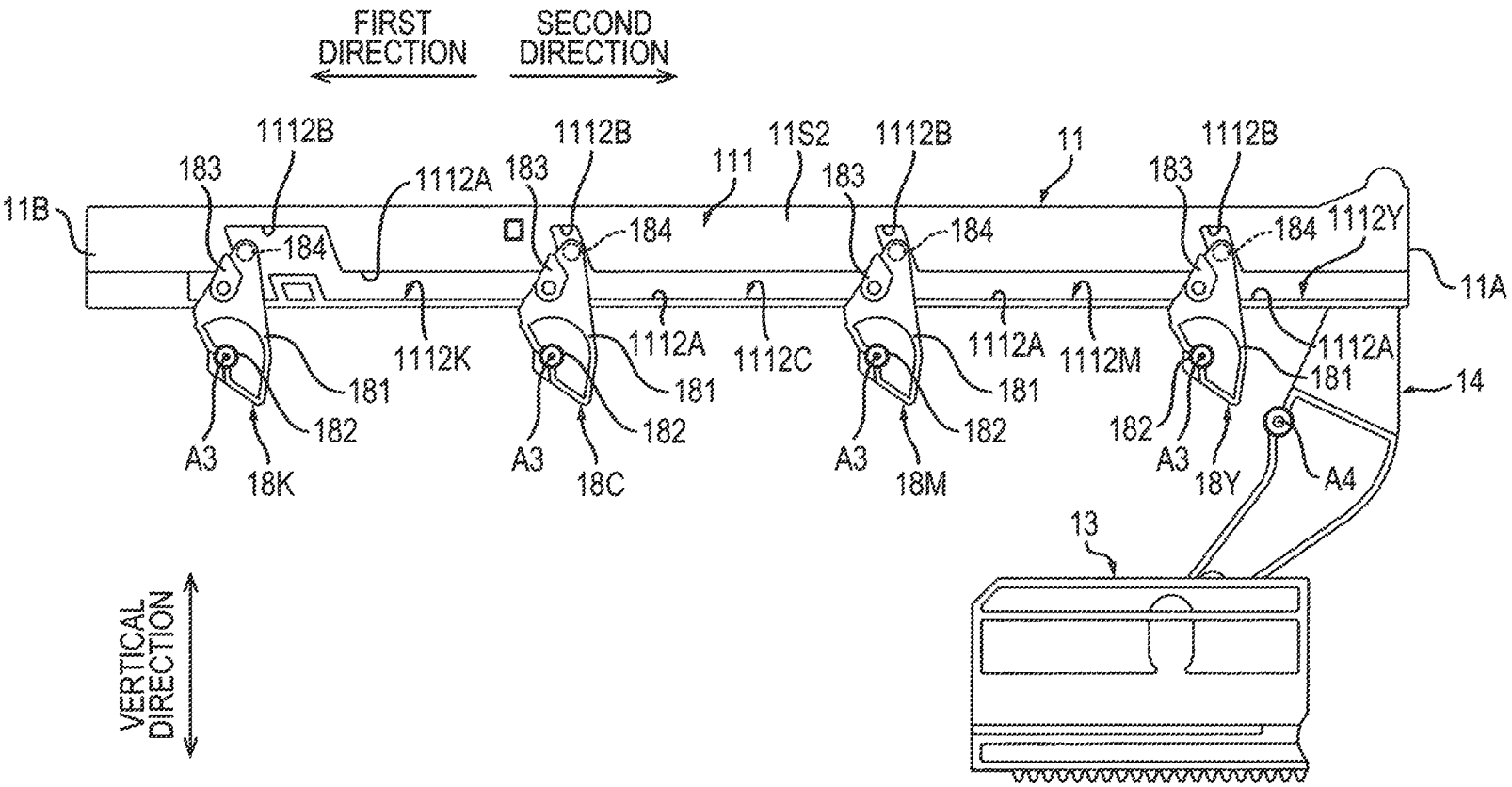
FIG. 12 is a side view of the first cam and arms shown in FIG. 11, and shows a state where the first cam is located at a first position.
Figure 13:
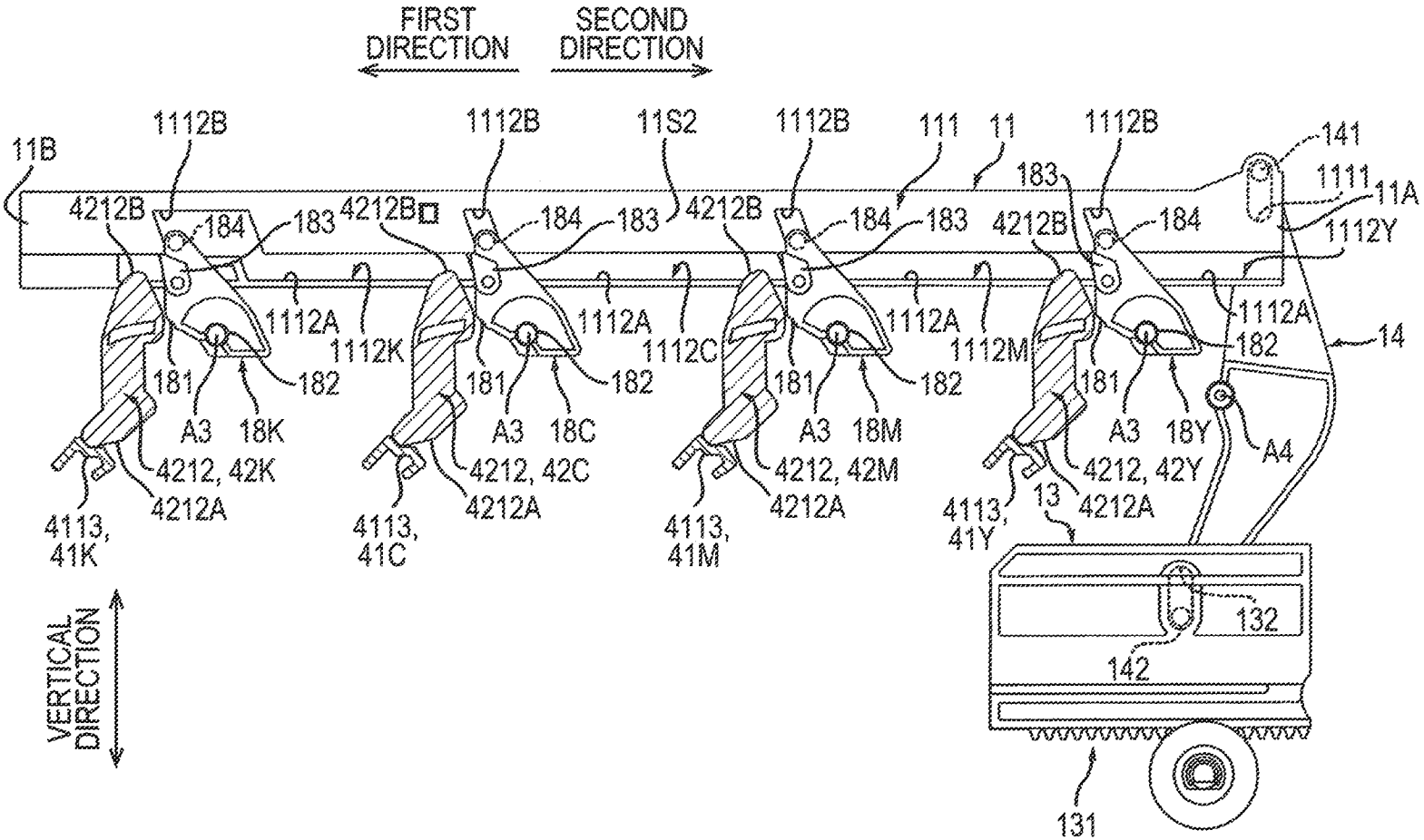
FIG. 13 is a side view of the first cam and the arms shown in FIG. 11, and shows a state where the first cam is located at a second position.
Figure 14:
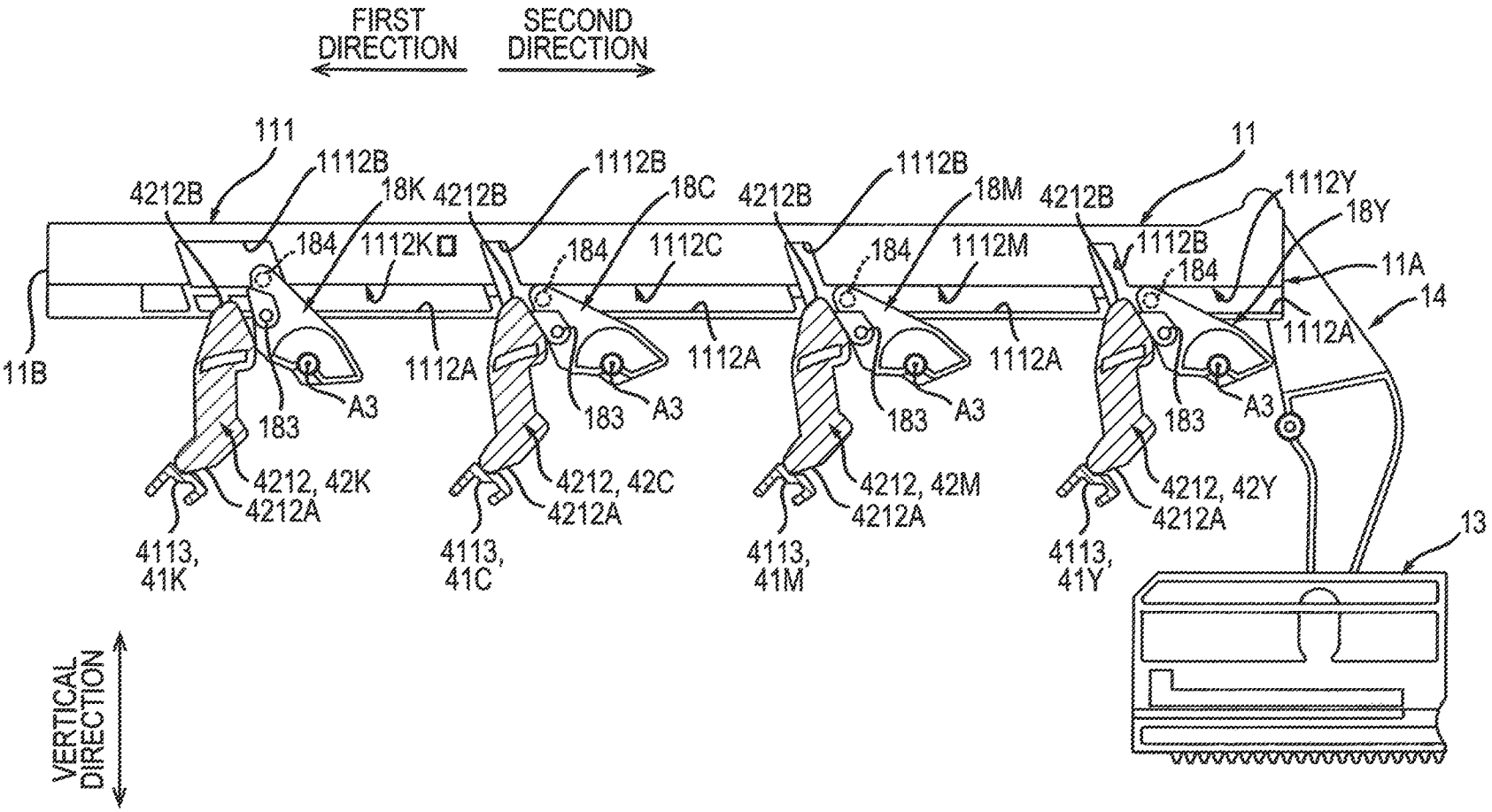
FIG. 14 is a side view of the first cam and the arms shown in FIG. 11, and shows a state where the first cam is located at a fourth position.

As shown in FIGS. 12 to 15, the first cam 11 is movable to a first position (see FIG. 12), a second position (see FIG. 13), a third position (see FIG. 15), and a fourth position (see FIG. 14).

As shown in FIG. 12, in a state where the cover 9 is located at the open position, the first cam 11 is located at the first position. In a state where the first cam 11 is located at the first position, each of the four cartridges 4Y, 4M, 4C, and 4K is attachable to and detachable from the housing 2 (see FIG. 2). In a state where the first cam 11 is located at the first position, the four first input portions 100Y, 100M, 100C, 100K are separated from the four drum couplings 418Y, 418M, 418C, 418K (see FIG. 5). In a state where the first cam 11 is located at the first position, the four second input portions 101Y, 101M, 101C, 101K are separated from the four development couplings 423Y, 423M, 423C, 423K (see FIG. 5).

As shown in FIG. 13, in a state where the cover 9 is located at the closed position (see FIG. 1), the first cam 11 moves from the first position to the second position in the first direction. In a state where the first cam 11 is located at the second position, the first cam 11 causes the photosensitive drum 412Y and the development roller 422Y to contact each other, causes the photosensitive drum 412M and the development roller 422M to contact each other, causes the photosensitive drum 412C and the development roller 422C to contact each other, and causes the photosensitive drum 412K and the development roller 422K to contact each other.

In a state where the first cam 11 is located at the second position, the four first input portions 100Y, 100M, 100C, and 100K fit into the four drum couplings 418Y, 418M, 418C, and 418K. In a state where the first cam 11 is located at the second position, the four second input portions 101Y, 101M, 101C, and 101K fit into the four development couplings 423Y, 423M, 423C, and 423K.

Figure 15:
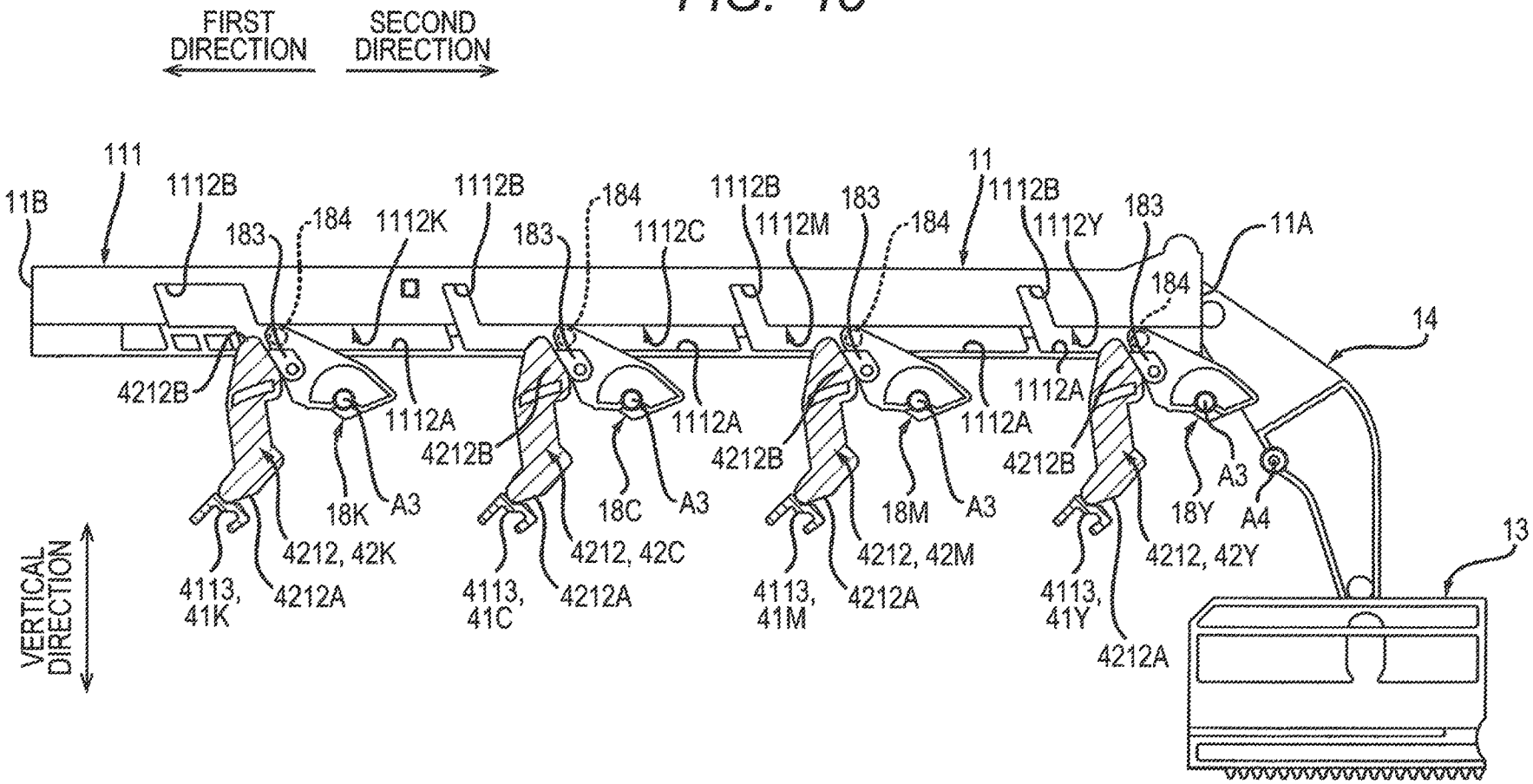
FIG. 15 is a side view of the first cam and the arms shown in FIG. 11, and shows a state where the first cam is located at a third position.

As shown in FIG. 15, in a state where the cover 9 is located at the closed position (see FIG. 1), the first cam 11 moves from the second position through the fourth position (see FIG. 14) to the third position in the first direction. In a state where the first cam 11 is located at the third position, the first cam 11 causes the photosensitive drum 412Y and the development roller 422Y to separate from each other, causes the photosensitive drum 412M and the development roller 422M to separate from each other, causes the photosensitive drum 412C and the development roller 422C to separate from each other, and causes the photosensitive drum 412K and the development roller 422K to separate from each other.

In a state where the first cam 11 is located at the third position, the four first input portions 100Y, 100M, 100C, and 100K are separated from the four drum couplings 418Y, 418M, 418C, and 418K. In a state where the first cam 11 is located at the third position, the four second input portions 101Y, 101M, 101C, and 101K are separated from the four development couplings 423Y, 423M, 423C, and 423K.

As shown in FIG. 14, the first cam 11 can be located at the fourth position between the second position and the third position. In a state where the first cam 11 is located at the fourth position, the first cam 11 causes the photosensitive drum 412Y and the development roller 422Y to separate from each other, causes the photosensitive drum 412M and the development roller 422M to separate from each other, causes the photosensitive drum 412C and the development roller 422C to separate from each other, and causes the photosensitive drum 412K and the development roller 422K to contact each other.

In a state where the first cam 11 is located at the fourth position, the three first input portions 100Y, 100M and 100C are separated from the three drum couplings 418Y, 418M and 418C, and the first input portion 100K fits in the drum coupling 418K. In a state where the first cam 11 is located at the fourth position, the three second input portions 101Y, 101M, and 101C are separated from the three development couplings 423Y, 423M, and 423C, and the second input portion 101K fits in the development coupling 423K.

As shown in FIG. 10, the first cam 11 includes a cam main body 111 and a rib 112.

4.1.1 Cam Main Body 111

The cam main body 111 extends in the first direction. The one end of the cam main body 111 in the first direction is the one end 11A of the first cam 11. The other end of the cam main body 111 in the first direction is the other end 11B of the first cam 11. The cam main body 111 has a first surface 11S1 and a second surface 11S2 in the third direction. The first surface 11S1 is located at the opposite side of the development housing 4211 with respect to the second surface 11S2 in the third direction (see FIG. 4).

As shown in FIGS. 11 and 12, the cam main body 111 has a first elongated hole 1111 (see FIG. 11) and four first grooves 1112Y, 1112M, 1112C, and 1112K (see FIG. 12).

4.1.1.1 First Elongated Hole 1111

As shown in FIG. 11, a first boss 141 of the rotating rod 14 fits into the first elongated hole 1111. The first boss 141 will be described later. The first elongated hole 1111 is located at one end of the first surface 11S1 in the first direction. The first elongated hole 1111 is recessed from the first surface 11S1 in the third direction. The first elongated hole 1111 extends in the vertical direction.

4.1.1.2 Four First Grooves 1112Y, 1112M, 1112C, 1112K

As shown in FIG. 12, the four first grooves 1112Y, 1112M, 1112C, and 1112K are located at the second surface 11S2. The four first grooves 1112Y, 1112M, 1112C, and 1112K are arranged in this order in the first direction.

4.1.1.2.1 First Groove 1112K

A boss 184 of the arm 18K fits into the first groove 1112K. The boss 184 will be described later. The first groove 1112K is recessed from the second surface 11S2 in the third direction. The first groove 1112K has a first portion 1112A and a second portion 1112B. The first portion 1112A extends in the first direction. The second portion 1112B is continuous with one end of the first portion 1112A in the first direction. The second portion 1112B extends in the first direction. The second portion 1112B is slanted in the first direction as it goes upward from the first portion 1112A.

4.1.1.2.2 Three First Grooves 1112Y, 1112M, and 1112C

Three first grooves 1112Y, 1112M, and 1112C are described in the same manner as the first groove 1112K, except for the dimension of the second portion 1112B in the first direction. Thus, the description of the first groove 1112Y, 1112M, and 1112C will be omitted. The boss 184 of the arm 18Y fits into the first groove 1112Y. The boss 184 of the arm 18M fits into the first groove 1112M. The boss 184 of the arm 18C fits into the first groove 1112C. In each of the first grooves 1112Y, 1112M and 1112C, the dimension of the second portion 1112B in the first direction is smaller than the dimension of the second portion 1112B of the first groove 1112K in the first direction.

4.1.2 Rib 112

As shown in FIG. 11, the rib 112 is located at the first surface 11S1 of the cam main body 111. The rib 112 is located between the one end 11A and the other end 11B in the first direction. The rib 112 protrudes from the first surface 11S1 in the third direction. The rib 112 extends in the first direction. The rib 112 has a light transmitting portion 1121. In other words, the first cam 11 has the light transmitting portion 1121.

The light transmitting portion 1121 is configured to transmit light L of the light emitting portion 61. The light emitting portion 61 will be described later. The light transmitting portion 1121 is located between the one end 11A and the other end 11B in the first direction. The light transmitting portion 1121 is a slit, for example.

The rib 112 includes a first rib 1122 and a second rib 1123. The light transmitting portion 1121 is located between the first rib 1122 and the second rib 1123. The first rib 1122 is located at the opposite side of the one end 11A with respect to the light transmitting portion 1121. The dimension of the first rib 1122 in the first direction is larger than the dimension of the light transmitting portion 1121 in the first direction. The second rib 1123 is located at the opposite side of the other end 11B with respect to the light transmitting portion 1121. The dimension of the second rib 1123 in the first direction is larger than the dimension of the first rib 1122 in the first direction.

4.2 Four Arms 18Y, 18M, 18C, 18K

As shown in FIG. 12, the four arms 18Y, 18M, 18C, and 18K are supported by the housing 2. The four arms 18Y, 18M, 18C, and 18K are spaced apart from each other in the first direction.

4.2.1 Arm 18K

The arm 18K is located between the first cam 11 and the first side surface SD1 of the development cartridge 42K in the third direction (see FIG. 4). The arm 18K is rotatable about an axis A3. The axis A3 extends in the third direction. The arm 18K rotates in conjunction with the movement of the first cam 11. The arm 18K includes an arm main body 181, a shaft 182, a boss 184, and a protrusion 183.

4.2.1.1 Arm Main Body 181

The arm main body 181 supports the shaft 182, the boss 184, and the protrusion 183.

4.2.1.2 Shaft 182

The shaft 182 extends along the axis A3. The shaft 182 is provided at one end of the arm main body 181. The shaft 182 is rotatably supported by the housing 2.

4.2.1.3 Boss 184

The boss 184 is provided at the other end of the arm main body 181. The boss 184 protrudes from the arm main body 181 toward the first cam 11. The boss 184 extends in the third direction.

In a state where the first cam 11 is located at the first position, the second position, or the fourth position, the boss 184 of the arm 18K fits into the second portion 1112B. In a state where the first cam 11 is located at the third position, the boss 184 of the arm 18K fits into the first portion 1112A.

4.2.1.4 Protrusion 183

The protrusion 183 is located at the opposite side of the boss 184 with respect to the arm main body 181 in the third direction. The protrusion 183 is located away from the axis A3 in the radial direction of the shaft 182. The protrusion 183 extends in the third direction. In a state where the cartridge 4K is located in the housing 2, the protrusion 183 of the arm 18K is located at the opposite side of the first contact portion 4113 of the drum cartridge 41K with respect to the second contact portion 4212 of the development cartridge 42K.

In a state where the first cam 11 is located at the first position, the second position, or the fourth position, the protrusion 183 of the arm 18K is separated from the second portion 4212B of the second contact portion 4212 of the development cartridge 42K. Thus, the development cartridge 42K is pressed by the two pressing members 416K and 417K and is located at the contact position (see FIG. 3A).

Figure 8:
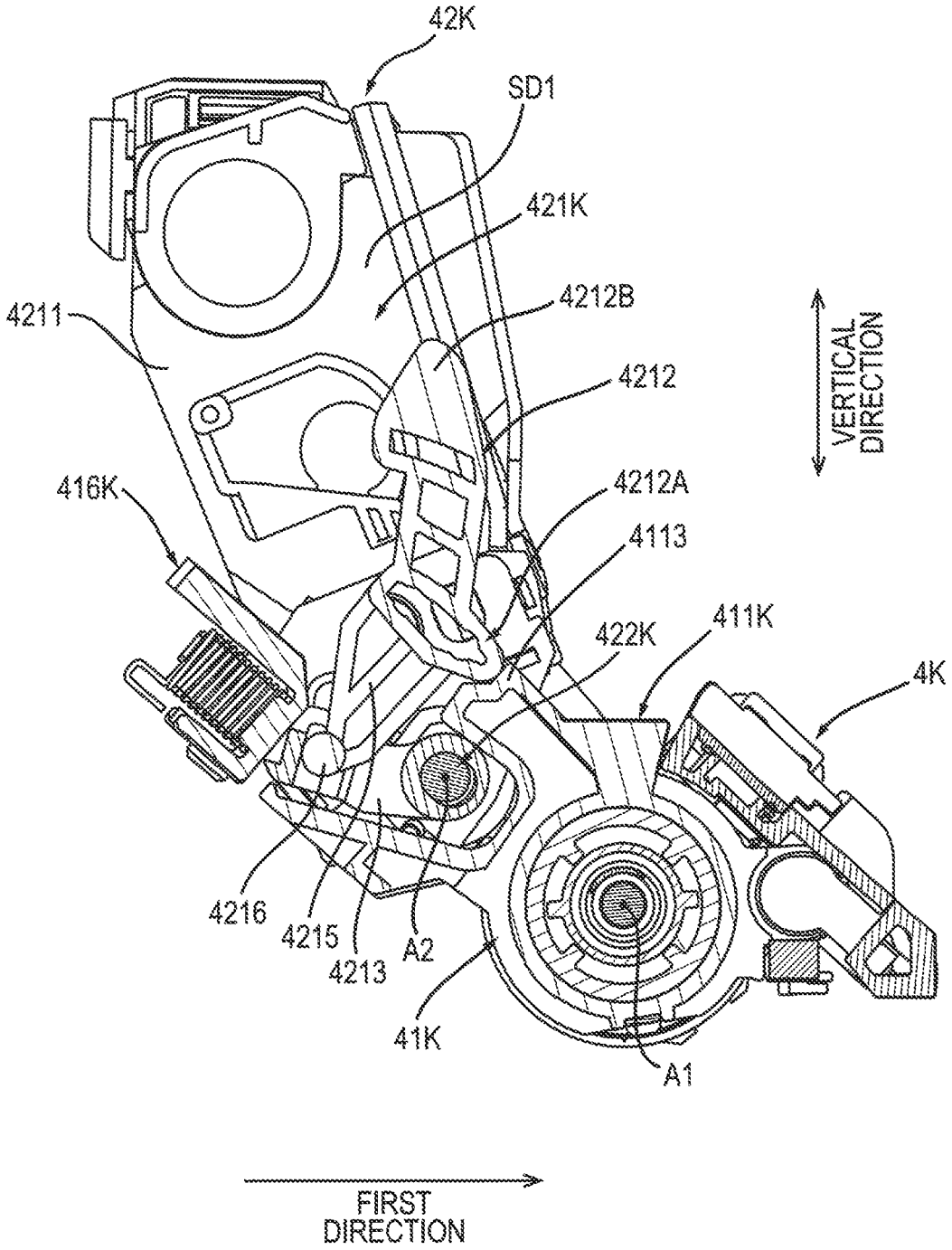
FIG. 8 is a side cross-sectional view of the first side wall and the second contact portion shown in FIG. 4, and shows a state where the development cartridge is located at the separation position.

As shown in FIG. 15, when the first cam 11 moves from the second position to the third position, the protrusion 183 of the arm 18K contacts the second portion 4212B of the second contact portion 4212 and presses the second portion 4212B. As a result, as shown in FIG. 8, the development cartridge 42K moves from the contact position to the separation position against the two pressing members 416K and 417K around the contact portion of the first portion 4212A of the second contact portion 4212 and the first contact portion 4113 as the fulcrum. More specifically, when the second contact portion 4212 rotationally moves clockwise in FIG. 6 around the contact portion between the first portion 4212A and the first contact portion 4113, the connection portion 4215 and the engagement portion 4216 move upward and presses the first support portion 4213 toward the pressing member 416K. Then, the first support portion 4213 presses the pressing member 416K upward against the urging force of the coil spring of the pressing member 416K. In this way, in a state where the first cam 11 is located at the third position, the development cartridge 42K is located at the separation position (see FIG. 3B).

4.2.2 Arms 18Y, 18M, 18C

As shown in FIG. 12, the arms 18Y, 18M, and 18C have the same configuration as the arm 18K. Thus, the description of the configuration of the arms 18Y, 18M, and 18C will be omitted.

In a state where the first cam 11 is located at the first position or the second position, the bosses 184 of the arms 18Y, 18M, and 18C fit into the second portion 1112B. In a state where the first cam 11 is located at the third position or the fourth position, the bosses 184 of the arms 18Y, 18M, and 18C fit into the first portion 1112A.

4.3 Second Cam 12

As shown in FIG. 10, the second cam 12 is located at a lower position than the first cam 11 in the vertical direction. The second cam 12 is located at the opposite side of the first cam 11 with respect to the four development frames 421Y, 421M, 421C, and 421K in the third direction (see FIG. 1). The second cam 12 is located away from the first cam 11 in the third direction.

When the first cam 11 moves in the first direction, the second cam 12 moves in the second direction. When the first cam 11 moves in the second direction, the second cam 12 moves in the first direction.

In a state where the first cam 11 is located at the first position or the second position, the second cam 12, in cooperation with the first cam 11, causes all the four development cartridges 42Y, 42M, 42C, and 42K to be located at the contact position (see FIG. 3A). In a state where the first cam 11 is located at the third position, the second cam 12, in cooperation with the first cam 11, causes all the four development cartridges 42Y, 42M, 42C, and 42K to be located at the separation position (see FIG. 3B).

Figure 16:
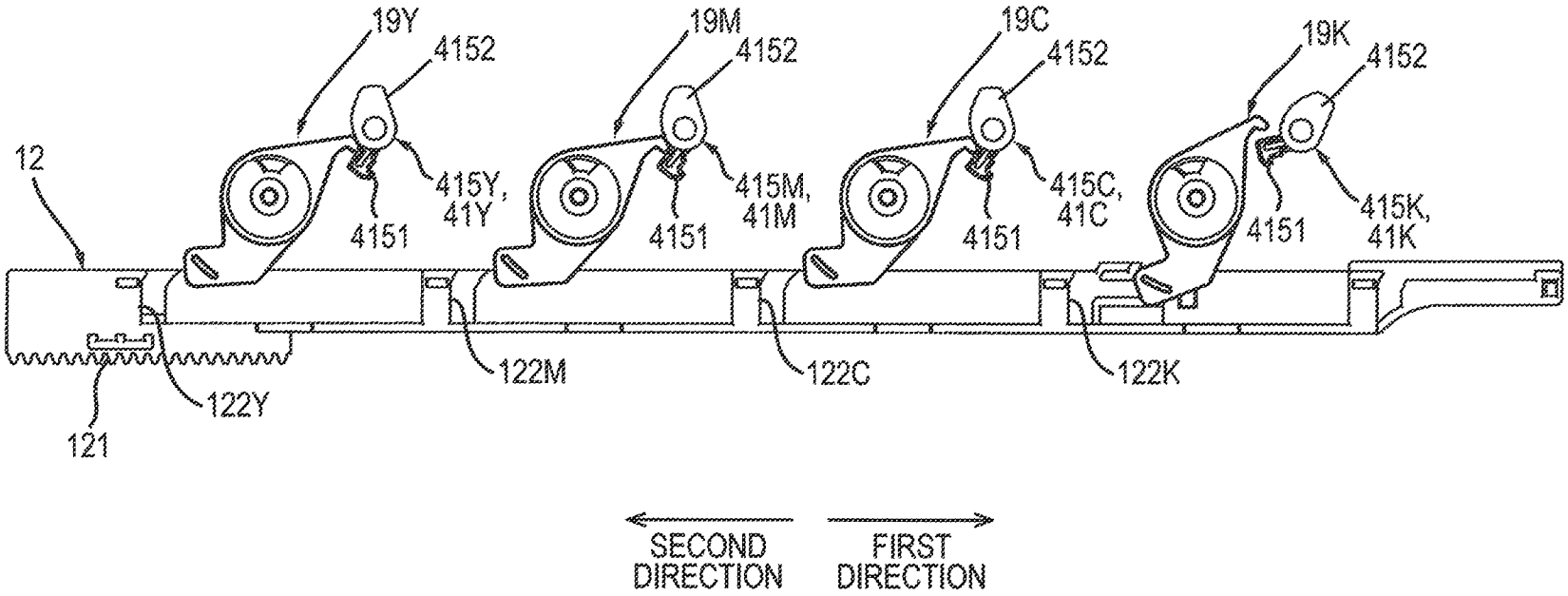
FIG. 16 is a side view of a second cam and levers shown in FIG. 11.

As shown in FIG. 16, in a state where the first cam 11 is located at the fourth position, the second cam 12, in cooperation with the first cam 11, causes the development cartridge 42K to be located at the contact position (see FIG. 2A) and causes the three development cartridges 42Y, 42M, and 42C to be located at the separation position (see FIG. 2B).

The second cam 12 has a first rack gear 121. Further, the second cam 12 has four second grooves 122Y, 122M, 122C and 122K.

4.3.1 First Rack Gear 121

The second cam 12 extends in the second direction. The second cam 12 has one end and an other end located away from the one end in the second direction. The first rack gear 121 is located on the lower surface of the second cam 12 at the one end. The first rack gear 121 extends in the second direction. The first rack gear 121 has a plurality of gear teeth.

4.3.2 Four Second Grooves 122Y, 122M, 122C, 122K

The four second grooves 122Y, 122M, 122C, and 122K are arranged in this order in the first direction.

A boss of the lever 19K fits into the second groove 122K. The boss is not shown. The second groove 122K is recessed in the third direction. The second groove 122K extends downward from the upper surface of the second cam 12.

The three second grooves 122Y, 122M, and 122C are described in the same manner as the second groove 122K, except for the dimension in the first direction. Thus, the description of the second grooves 122Y, 122M, and 122C will be omitted. The boss of the lever 19Y fits into the second groove 122Y. The boss of the lever 19M fits into the second groove 122M. The boss of the lever 19C fits into the second groove 122C. The dimension of each of the second grooves 122Y, 122M, and 122C in the first direction is smaller than the dimension of the second groove 122K in the second direction.

4.4 Four Levers 19Y, 19M, 19C, 19K

The four levers 19Y, 19M, 19C, and 19K are supported by the housing 2. The four levers 19Y, 19M, 19C, and 19K are located at intervals from each other in the first direction.

4.4.1 Lever 19K

The lever 19K is rotatable about an axis. The axis of the lever 19K extends in the third direction. The lever 19K rotates in conjunction with the movement of the second cam 12. In a state where the first cam 11 is located at the first position, the second position, or the fourth position, the lever 19K is separated from the third contact portion 4151 of the rotating member 415K of the drum cartridge 41K. Thus, the lever 19K, in cooperation with the arm 18K, causes the development cartridge 42K to be located at the contact position (see FIG. 3A).

Figure 9:
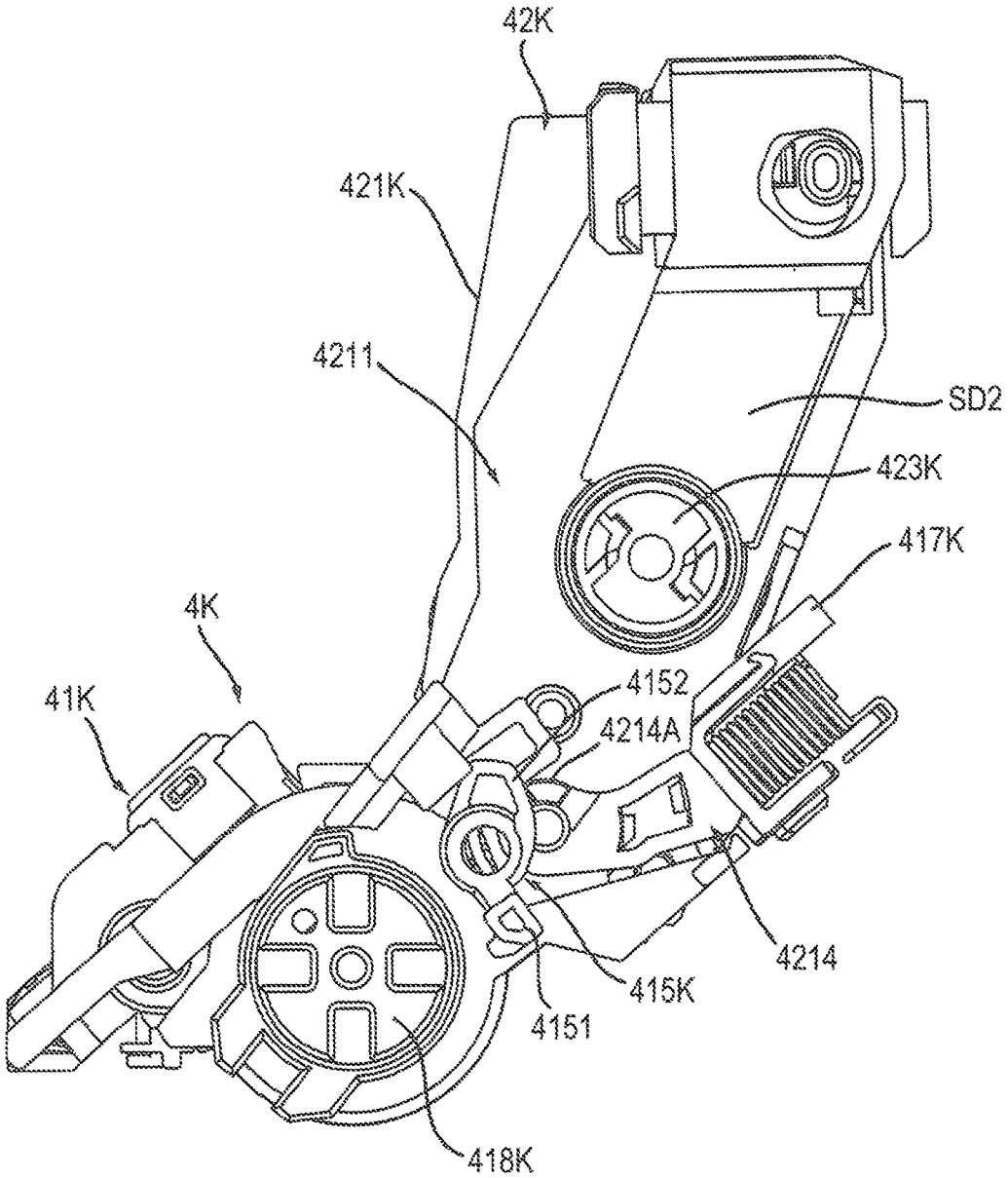
FIG. 9 is a side view of the rotating member and the second support portion shown in FIG. 5, and shows a state where the development cartridge is located at the separation position.

When the first cam 11 moves from the second position to the third position, the lever 19K contacts the third contact portion 4151 of the rotating member 415K of the drum cartridge 41K and presses the third contact portion 4151. Then, as shown in FIG. 9, the rotating member 415K rotates, and the fourth contact portion 4152 contacts the protrusion 4214A of the second support portion 4214. As a result, the development cartridge 42K moves from the contact position to the separation position against the two pressing members 416K and 417K. Thus, in a state where the first cam 11 is located at the third position, the lever 19K, in cooperation with the arm 18K, causes the development cartridge 42K to be located at the separation position (see FIG. 2B).

4.4.2 Lever 19Y, 19M, 19C

The levers 19Y, 19M, and 19C have the same configuration as the lever 19K. Thus, the description of the configurations of the levers 19M, 19C, and 19K will be omitted.

In a state where the first cam 11 is located at the first position or the second position, each of the levers 19Y, 19M, and 19C is separated from the third contact portion 4151 of the rotating member 415Y, 415M, and 415C. Thus, the levers 19Y, 19M and 19C, in cooperation with the arms 18Y, 18M and 18C, cause the development cartridges 42Y, 42M and 42C to be located at the contact position (see FIG. 3A).

In a state where the first cam 11 is located at the third position or the fourth position, each of the levers 19Y, 19M, and 19C contacts the third contact portion 4151 of the rotating member 415Y, 415M, and 415C. Thus, the levers 19Y, 19M and 19C, in cooperation with the arms 18Y, 18M and 18C, cause the development cartridges 42Y, 42M and 42C to be located at the separation position (see FIG. 3B).

4.5 Link Member 13

As shown in FIG. 10, the link member 13 is located away from the second cam 12 in the third direction. The link member 13 is located below the first cam 11 in the vertical direction. The link member 13 moves in conjunction with the second cam 12. The link member 13 has a second rack gear 131. Further, the link member 13 has a second elongated hole 132 (see FIG. 11).

4.5.1 Second Rack Gear 131

The second rack gear 131 is located on the lower surface of the link member 13. The second rack gear 131 extends in the second direction. The second rack gear 131 includes a plurality of gear teeth. The number of gear teeth of the second rack gear 131 is the same as the number of gear teeth of the first rack gear 121. The module of the gear teeth of the second rack gear 131 is the same as the module of the gear teeth of the first rack gear 121.

4.5.2 Second Elongated Hole 132

As shown in FIG. 11, the second boss 142 of the rotation rod 14 fits into the second elongated hole 132. The second boss 142 will be described later. The second elongated hole 132 is located at the side surface of the link member 13. The second elongated hole 132 extends in the vertical direction.

4.6 Rotation Rod 14

The rotation rod 14 links the movement of the first cam 11 with the movement of the link member 13. The rotation rod 14 connects the first cam 11 and the link member 13. The rotation rod 14 is supported by the housing 2. The rotation rod 14 is rotatable about an axis A4. The axis A4 extends in the third direction. The rotation rod 14 is located at the opposite side of the second cam 12 with respect to the first cam 11 in the third direction. The rotation rod 14 has a triangular shape when viewed from the third direction. The rotation rod 14 includes a first boss 141 and a second boss 142.

4.6.1 First Boss 141

The first boss 141 is provided at one end of the rotation rod 14. The first boss 141 extends in the third direction. The first boss 141 fits into the first elongated hole 1111. With this configuration, the one end of the rotation rod 14 is connected to the first cam 11. In a state where the first boss 141 is fitted in the first elongated hole 1111, the first elongated hole 1111 has play in the vertical direction.

4.6.2 Second Boss 142

The second boss 142 is provided at the other end of the rotation rod 14. The second boss 142 extends in the third direction. The second boss 142 fits into the second elongated hole 132. With this configuration, the other end of the rotation rod 14 is connected to the link member 13. In a state where the second boss 142 is fitted in the second elongated hole 132, the second elongated hole 132 has play in the vertical direction.

4.7 First Gear 15

As shown in FIG. 10, the first gear 15 transmits a driving force to the second cam 12. The first gear 15 is a pinion gear that engages the first rack gear 121. The first gear 15 has a plurality of gear teeth.

4.8 Second Gear 16

The second gear 16 transmits a driving force to the link member 13. The second gear 16 is a pinion gear that engages the second rack gear 131. The second gear 16 has a plurality of gear teeth. The number of gear teeth of the second gear 16 is the same as the number of gear teeth of the first gear 15. The module of the gear teeth of the second gear 16 is the same as the module of the gear teeth of the first gear 15.

4.9 Shaft 17

The shaft 17 connects the first gear 15 and the second gear 16. The shaft 17 extends in the third direction. The shaft 17 has one end and an other end located away from the one end in the third direction. The first gear 15 is attached to the one end of the shaft 17. The second gear 16 is attached to the other end of the shaft 17.

4.10 Motor 102

As shown in FIG. 11, the motor 102 drives the first cam 11 and the second cam 12. The motor 102 is connected to the first gear 15 via a gear train (not shown).

4.10' Electromagnetic Clutch 103

The electromagnetic clutch 103 is included in the gear train connecting the motor 102 and the first gear 15. The electromagnetic clutch 103 is configured to be switched between a transmission state and a release state. When the electromagnetic clutch 103 is in the transmission state, the motor 102 transmits the driving force to the first gear 15. When the electromagnetic clutch 103 is in the release state, the electromagnetic clutch 103 releases the transmission of the driving force from the motor 102 to the first gear 15.

4.11 Sensor 6

The sensor 6 includes a light emitting portion 61 and a light receiving portion 62. The sensor 6 detects the light received by the light receiving portion 62. The light emitting portion 61 emits light L. The light receiving portion 62 receives the light L from the light emitting portion 61. The light receiving portion 62 is located away from the light emitting portion 61. The light receiving portion 62 is located at the opposite side of the light emitting portion 61 with respect to the rib 112 in the vertical direction.

As shown in FIGS. 17A to 17D, the rib 112 of the first cam 11 transmits and blocks the light L from the light emitting portion 61 of the sensor 6.

Figures 17A, 17B, 17C, 17D:
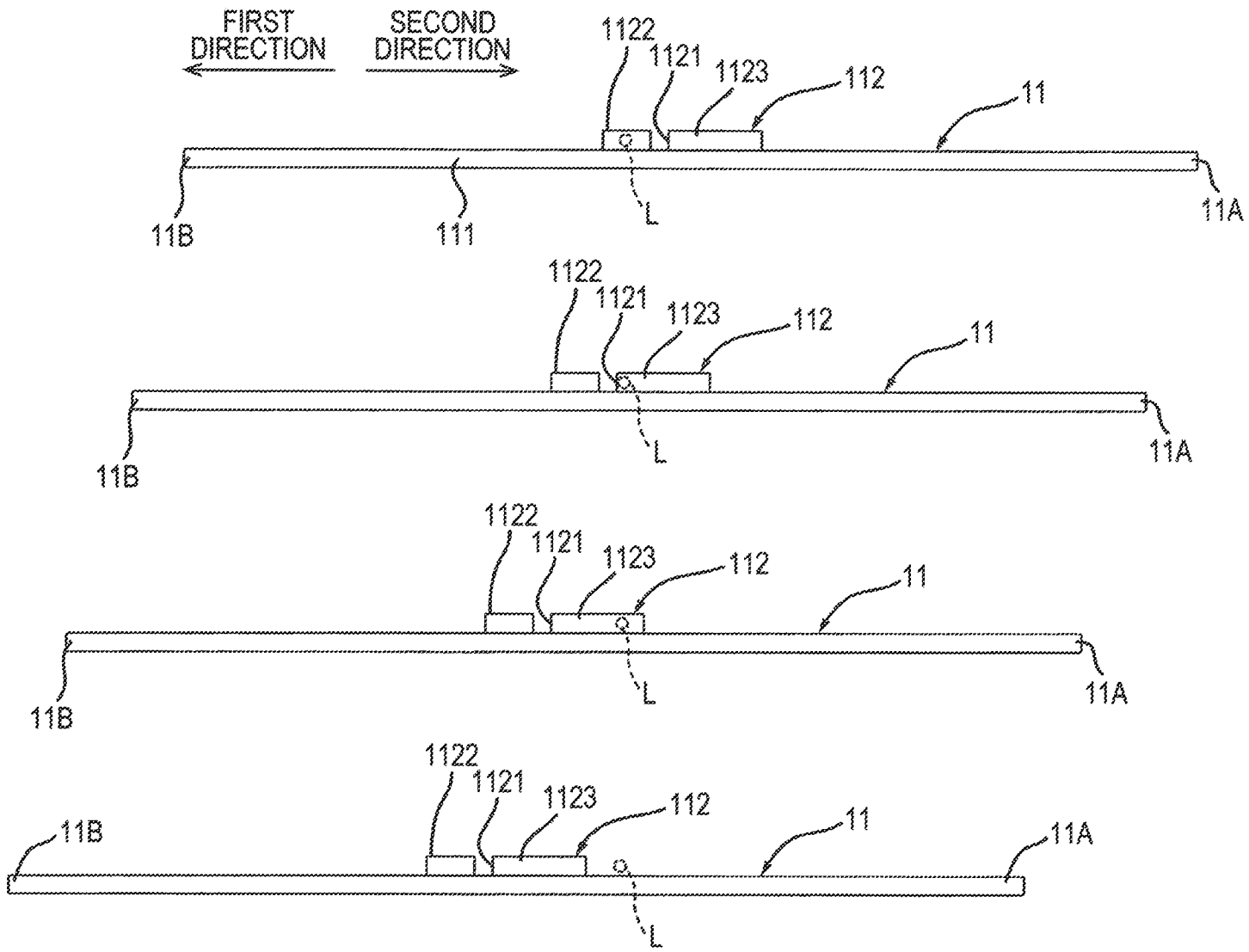
FIG. 17A is a plan view of the first cam shown in FIG. 12, and shows a state where the first cam is located at the first position.
FIG. 17B is a plan view of the first cam shown in FIG. 13 and shows a state where the first cam is located at the second position.
FIG. 17C is a plan view of the first cam shown in FIG. 14, and shows a state where the first cam is located at the fourth position.
FIG. 17D is a plan view of the first cam shown in FIG. 15 and shows a state where the first cam is located at the third position.

As shown in FIG. 17A, in a state where the first cam 11 is located at the first position, the first rib 1122 of the rib 112 is located between the light emitting portion 61 and the light receiving portion 62 to block the light L from the light emitting portion 61. As a result, the sensor 6 detects the first rib 1122. When the first cam 11 is located at the first position, the slit as the light transmitting portion 1121 is located closer to the one end 11A than the light L from the light emitting portion 61 is.

In a state where the first cam 11 is located at the second position or the fourth position, the second rib 1123 of the rib 112 is located between the light emitting portion 61 and the light receiving portion 62 to block the light L from the light emitting portion 61. As a result, the sensor 6 detects the second rib 1123. When the first cam 11 is located at the second position or the fourth position, the slit as the light transmitting portion 1121 is located closer to the other end 11B than the light L from the light emitting portion 61 is.

In a state where the first cam 11 is located at the third position, the rib 112 is not located between the light emitting portion 61 and the light receiving portion 62 and does not block the light L from the light emitting portion 61.

4.12 Controller 10

As shown in FIG. 10, the controller 10 is electrically connected to the light emitting portion 61, the light receiving portion 62, the motor 102, and the electromagnetic clutch 103. At the time of an initial operation, the controller 10 determines whether the first cam 11 is at the first position, the second position, or the third position based on the detection result of the sensor 6. The initial operation is performed when the cover 9 is opened and then closed, or when the power is turned on, for example. By receiving the electric signal from the sensor 6, the controller 10 determines whether the sensor 6 has detected the rib 112 of the first cam 11. The controller 10 can switch the motor 102 on and off. The controller 10 switches the rotation direction of the motor 102. The controller 10 switches between the transmission state and the release state of the electromagnetic clutch 103. The controller 10 is, for example, a circuit board on which an ASIC is mounted, a circuit board on which a CPU is mounted, and so on.

5. Operation of Image Forming Apparatus 1

The operation of the image forming apparatus 1 will be described with reference to FIGS. 18 to 21.

Figure 18:
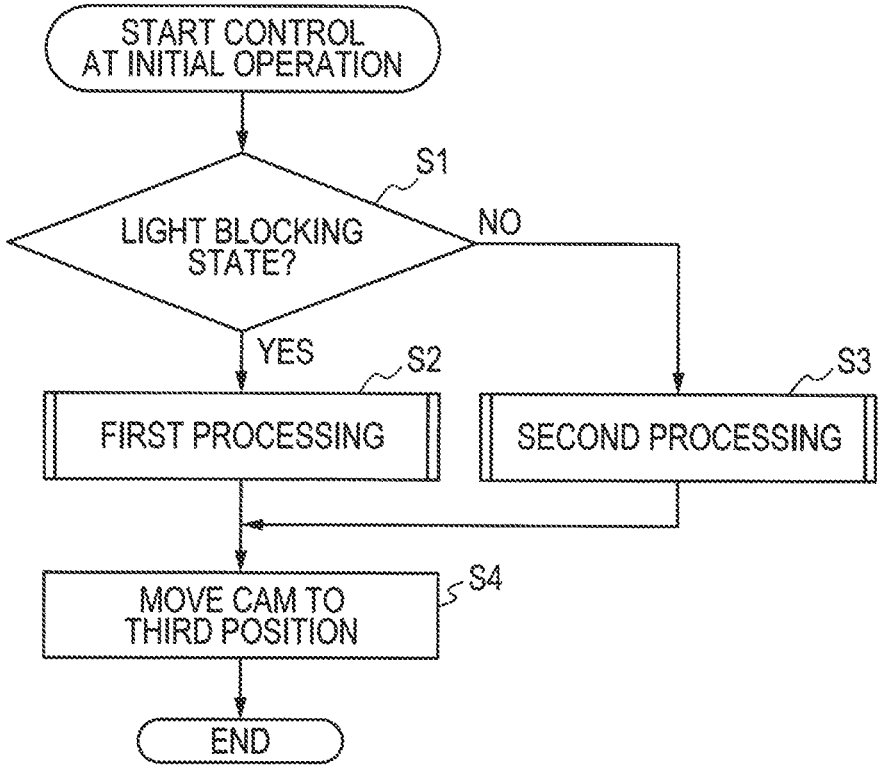
FIG. 18 is a flowchart for explaining the control of the image forming apparatus shown in FIG. 1 at the time of initial operation.

As shown in FIG. 18, at the time of the initial operation of the image forming apparatus 1, the controller 10 executes determination processing (S1), first processing (S2) or second processing (S3), and cam movement processing (S4).

5.1 Determination Processing (S1)

In the determination processing (S1), the controller 10 transmits a signal to the light emitting portion 61 to cause the light emitting portion 61 to emit light L. Subsequently, the controller 10 determines whether the light receiving portion 62 is in a light blocking state where light L is not received, or the light receiving portion 62 is in a light receiving state where light L is being received. In the determination processing (S1), the electromagnetic clutch 103 is in the release state.

5.2 First Processing (S2)

When the light receiving portion 62 is in a light blocking state during the initial operation (Yes in S1), in other words, when the light L of the sensor 6 is blocked during the initial operation, the controller 10 executes the first processing (S2).

When the light receiving portion 62 is in a light blocking state during the initial operation (Yes in S1), the first cam 11 is located at the first position (see FIG. 17A), the second position (see FIG. 17B), or the fourth position (see FIG. 17C).

Figure 19:
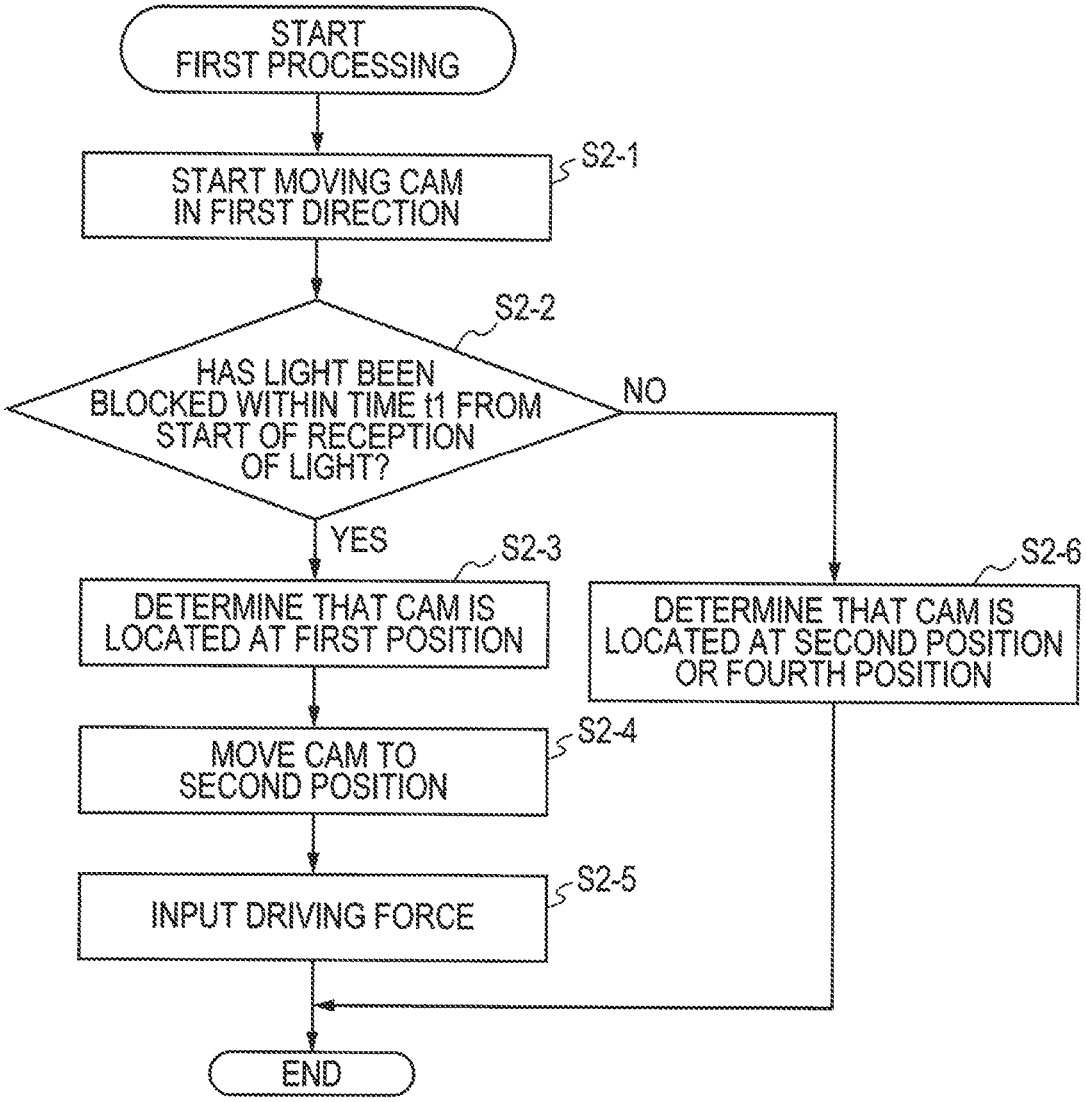
FIG. 19 is a flowchart for explaining first processing shown in FIG. 18.

As shown in FIG. 19, in the first processing, first, the first cam 11 is moved in the first direction at a particular speed by a particular distance (S2-1). The moving distance of the first cam 11 in the first processing is larger than or equal to the dimension of the second rib 1123 in the first direction and is smaller than or equal to the sum of the dimension of the second rib 1123 and the dimension of the light transmitting portion 1121 in the first direction.

Specifically, in the first processing (S2), the controller 10 rotates the motor 102 in a first rotation direction. Then, the controller 10 switches the electromagnetic clutch 103 from the release state to the transmission state. As a result, the driving force from the motor 102 is transmitted to the first gear 15. Then, the first gear 15 and the second gear 16 rotate at the same time. Then, the second cam 12 and the link member 13 move in the second direction at the same time. When the link member 13 moves, the rotating rod 14 rotates. As a result, the first cam 11 moves in the first direction at a particular speed.

Subsequently, the controller 10 determines whether the light receiving portion 62 has received the light L after the first cam 11 started moving and the light L from the first light emitting portion 61 has been blocked within a first particular time t1 after the light receiving portion 62 starts receiving the light L (S2-2).

The first particular time t1 is a time in which the first cam 11 moves in the first direction at the particular speed by the same distance as the dimension of the light transmitting portion 1121.

Figure 22A:
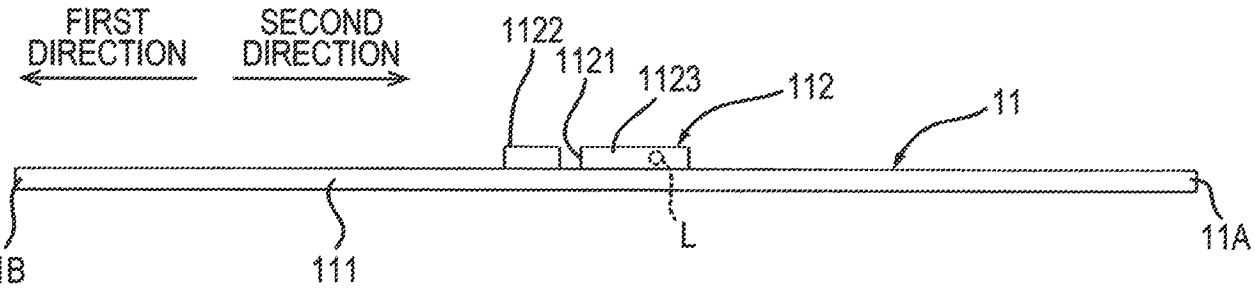
FIG. 22A shows a state where the first cam has moved from the first position in a first direction in the processing of S2-1 shown in FIG. 19.

For example, when the first cam 11 is located at the first position during the initial operation, as shown in FIGS. 17A and 22A, the transmitting portion 1121 passes between the light emitting portion 61 and the light receiving portion 62 when the first cam 11 moves from the first position in the first direction at a particular speed. At this time, the light receiving portion 62 receives the light L from the light emitting portion 61 for the first particular time t1. After that, when the second rib 1123 reaches the position between the light emitting portion 61 and the light receiving portion 62, the second rib 1123 blocks the light L from the light emitting portion 61. That is, the light receiving portion 62 switches from the light receiving state to the light blocking state after switching from the light blocking state to the light receiving state. After that, the controller 10 switches the electromagnetic clutch 103 from the transmission state to the release state. As a result, the first cam 11 stops in a state where the second rib 1123 blocks the light L of the light emitting portion 61.

In other words, as shown in FIG. 19, the controller 10 determines that the light receiving portion 62 has received the light L after the first cam 11 starts moving and the light of the sensor 6 has been blocked within the particular time t1 after the light receiving portion 62 starts receiving the light (Yes in S2-2). In this case, the controller 10 determines that the first cam 11 has been located at the first position during the initial operation (S2-3).

Then, when the controller 10 determines that the first cam 11 is at the first position, the controller 10 moves the first cam 11 to the second position (S2-4).

Subsequently, in a state where the first cam 11 is located at the second position, the controller 10 inputs the driving force from the four first input portions 100Y, 100M, 100C, and 100K to the four photosensitive drums 412Y, 422M, 422C, and 422K and inputs the driving force from the four second input portions 101Y, 101M, 101C, and 101K to the four development rollers 422Y, 422M, 422C, and 422K (S2-5).

Specifically, the controller 10 rotates the four first input portions 100Y, 100M, 100C, and 100K, and rotates the four second input portions 101Y, 101M, 101C, and 101K.

In a state where the first cam 11 is located at the second position, all the four development cartridges 42Y, 42M, 42C, and 42K are in the contact positions. Thus, the development roller 422Y rotates in a state where the development roller 422Y is in contact with the photosensitive drum 412Y. Then, the development cartridge 42K receives such a force that the development cartridge 42K approaches the first side wall 4111 of the drum cartridge 41K in the third direction. As a result, the second contact portion 4212 of the development cartridge 42K is arranged close to the first cam 11 in the third direction and faces the protrusion 183 of the arm 18K in the first direction (see FIG. 13).

Similarly, in the three development cartridges 42Y, 42M, and 42C, the second contact portion 4212 is arranged near the first cam 11 in the third direction and faces the protrusion 183 in the first direction.

As a result, when the first cam 11 moves from the second position to the third position, the protrusion 183 is reliably brought into contact with the second portion 4212B of the second contact portion 4212.

Figure 22B:
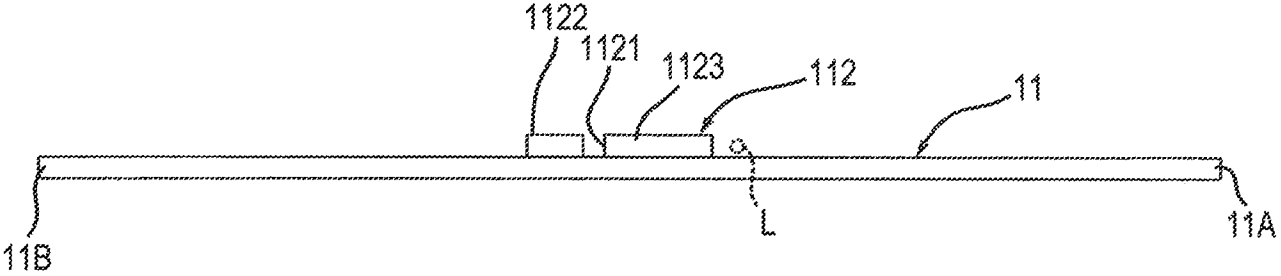
FIG. 22B shows a state where the first cam has moved from the second position in the first direction in the processing of S2-1 shown in FIG. 19.
Figure 22C:
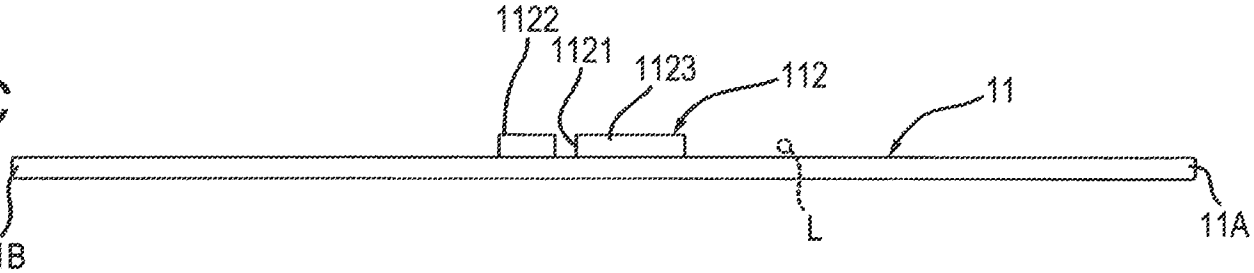
FIG. 22C shows a state where the first cam has moved from the fourth position in the first direction in the processing of S2-1 shown in FIG. 19.

Further, as shown in FIGS. 17B and 17C, when the first cam 11 is located at the second position or the fourth position and the light receiving portion 62 is in a light blocking state during the initial operation (Yes in S1), the light blocking state of the light receiving portion 62 is maintained until the second rib 1123 passes between the light emitting portion 61 and the light receiving portion 62 when the first cam 11 moves from the first position in the first direction at a particular speed. After that, as shown in FIGS. 22B and 22C, when the second rib 1123 has passed between the light emitting portion 61 and the light receiving portion 62, the light receiving portion 62 receives the light L from the light emitting portion 61. That is, the light receiving portion 62 switches from the light blocking state to the light receiving state. After that, the controller 10 switches the electromagnetic clutch 103 from the transmission state to the release state. As a result, the first cam 11 stops in a state where the light receiving portion 62 receives the light L of the light emitting portion 61. Thus, the light receiving portion 62 receives the light L for more than the first particular time t1 from the start of light receiving.

In this case, as shown in FIG. 19, the controller 10 determines that the light receiving portion 62 has received the light L after the first cam 11 starts moving and the light receiving portion 62 has received the light L for more than the particular time t1 after the light receiving portion 62 starts receiving the light (No in S2-2). Then, the controller 10 determines that the first cam 11 was arranged at the second position or the fourth position during the initial operation (S2-6).

In this way, the first processing is completed.

5.3 Cam Movement Processing

In this embodiment, the controller 10 has not received a print job. Thus, as shown in FIG. 18, after the completion of the first processing, the controller 10 moves the first cam 11 to the third position as a desired position (S4).

In other words, when the controller 10 determines that the first cam 11 is at the second position or the fourth position during the initial operation, the controller 10 moves the first cam 11, which has moved in the first direction, in the second direction so as to be moved to the third position (see FIGS. 18 and 19).

As described above, the operation of the image forming apparatus 1 is completed, and the first cam 11 is located at the third position.

5.4 Second Processing

As shown in FIG. 18, when the light receiving portion 62 is in the light receiving state during the initial operation (No in S1), in other words, when the light L from the light emitting portion 61 is received by the light receiving portion 62 during the initial operation, the controller 10 executes the second processing (S3).

Figure 23A:
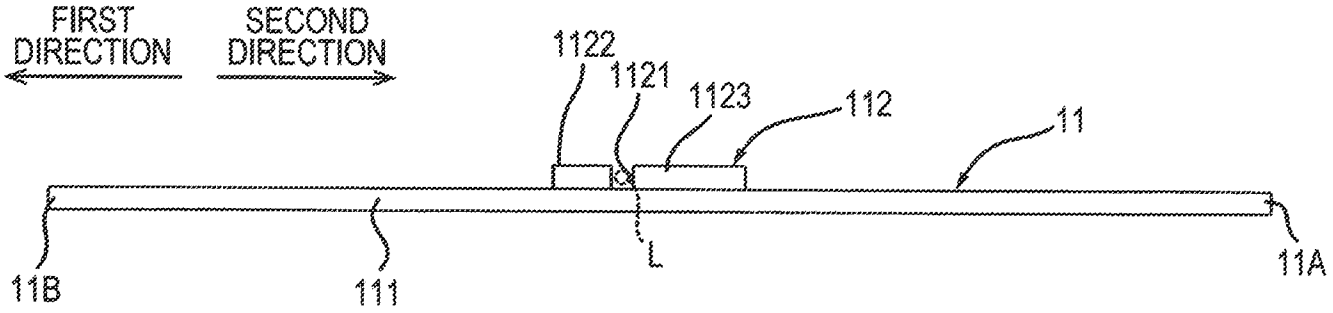
FIG. 23A shows a state where the first cam shown in FIG. 11 is located between the first position and the second position.

When the light receiving portion 62 is in the light receiving state during the initial operation (No in S1), the first cam 11 is located at the third position (see FIG. 17D) or at a position between the first position and the second position (see FIG. 23A).

Figure 20:
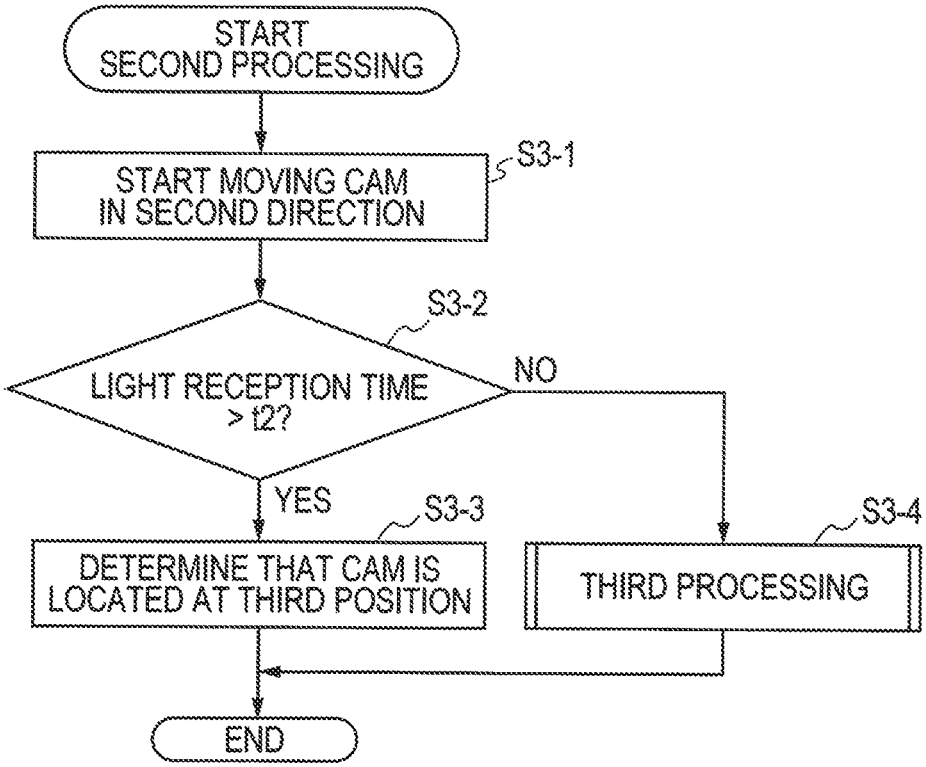
FIG. 20 is a flowchart for explaining second processing shown in FIG. 18.

As shown in FIG. 20, in the second processing, first, the first cam 11 is moved in the second direction at a particular speed by a particular distance (S3-1). The moving distance of the first cam 11 in the second processing is larger than or equal to the dimension of the light transmitting portion 1121 in the second direction and is smaller than or equal to the dimension of the first rib 1122 in the second direction.

Specifically, in the second processing (S3), the controller 10 rotates the motor 102 in a second rotation direction. The second rotation direction is the opposite direction of the first rotation direction. Then, the controller 10 switches the electromagnetic clutch 103 from the release state to the transmission state. As a result, the driving force from the motor 102 is transmitted to the first gear 15. Then, the second cam 12 moves in the first direction, and the first cam 11 moves in the second direction at a particular speed.

Subsequently, the controller 10 determines whether the light receiving portion 62 continues to receive light for more than the second particular time t2 from the start of movement of the first cam 11 (S3-2).

The second particular time t2 is the time in which the first cam 11 moves in the second direction at a particular speed by the same distance as the dimension of the light transmitting portion 1121.

Figure 22D:
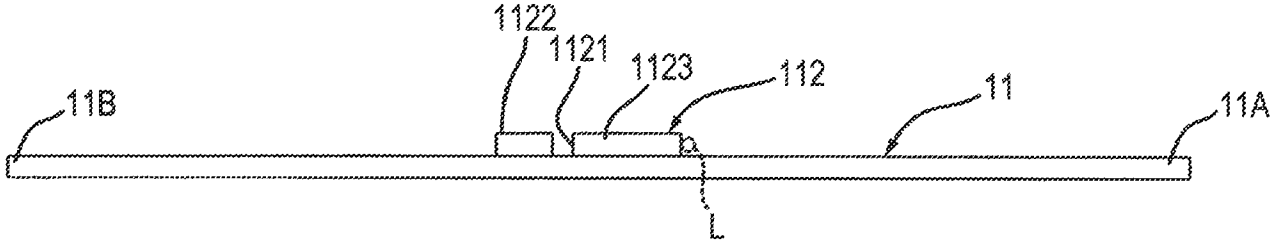
FIG. 22D shows a state where the first cam has moved from the third position in a second direction in the processing of S3-1 shown in FIG. 20.

For example, when the first cam 11 is located at the third position (see FIG. 17D) during the initial operation, the light receiving state of the light receiving portion 62 is maintained even when the first cam 11 moves in the second direction at a particular speed from the first position as shown in FIG. 22D. After that, the controller 10 switches the electromagnetic clutch 103 from the transmission state to the release state. As a result, the first cam 11 stops in a state where the light receiving portion 62 receives the light L of the light emitting portion 61. Thus, the light receiving portion 62 receives the light L for more than the particular time t2 from the start of movement of the first cam 11.

In this case, as shown in FIG. 20, the controller 10 determines that the light receiving portion 62 continues to receive light for more than the particular time t2 after the start of movement of the first cam 11 (Yes in S3-2). Then, the controller 10 determines that the first cam 11 was arranged at the third position during the initial operation (S3-3).

In this way, the second processing is completed.

As shown in FIG. 18, after the completion of the second processing, the controller 10 executes the cam movement processing (S4). In other words, when the controller 10 determines that the first cam 11 is at the third position during the initial operation, the controller 10 moves the first cam 11, which has moved in the second direction, again in the first direction so as to be moved to the third position (see FIG. 20).

Further, as shown in FIG. 23A, if the power of the image forming apparatus 1 is turned off in the middle of the period in which the first cam 11 is moving from the first position to the second position, the first cam 11 is stopped at a position between the first position and the second position. Then, the light transmitting portion 1121 may be located between the light emitting portion 61 and the light receiving portion 62, and the light receiving portion 62 may be in the light receiving state.

Figure 23B:
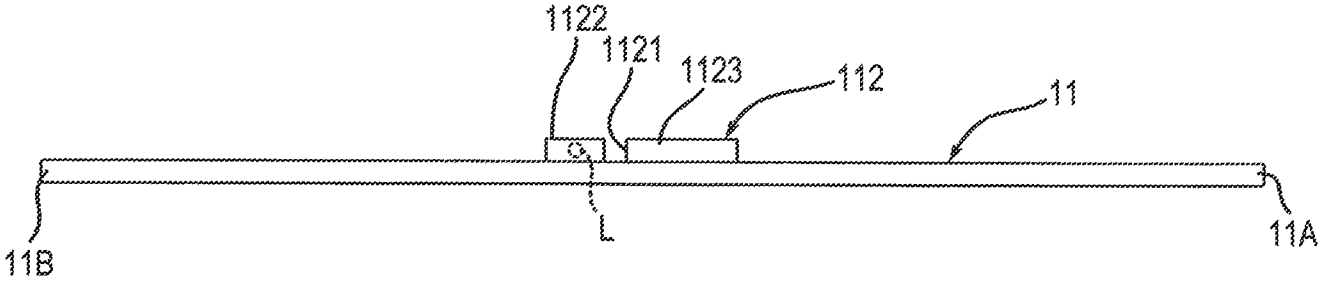
FIG. 23B shows a state where the first cam shown in FIG. 23A has moved in the second direction from a position between the first position and the second position in the processing of S3-1 shown in FIG. 20.

In this case, when the first cam 11 moves in the second direction at a particular speed (S3-1), as shown in FIG. 23B, the first rib 1122 reaches the position between the light emitting portion 61 and the light receiving portion 62 within the second particular time t2. Thus, the light receiving portion 62 switches from the light receiving state to the light blocking state within the second particular time t2. After that, the controller 10 switches the electromagnetic clutch 103 from the transmission state to the release state. As a result, the first cam 11 stops in a state where the first rib 1122 blocks the light L of the light emitting portion 61.

Thus, as shown in FIG. 20, the controller 10 determines that the light L of the sensor 6 is blocked within the particular time t2 after the first cam 11 starts moving (No in S3-2). In this case, the controller 10 executes the third processing (S3-4).

5.4.1 Third Processing

Figure 21:
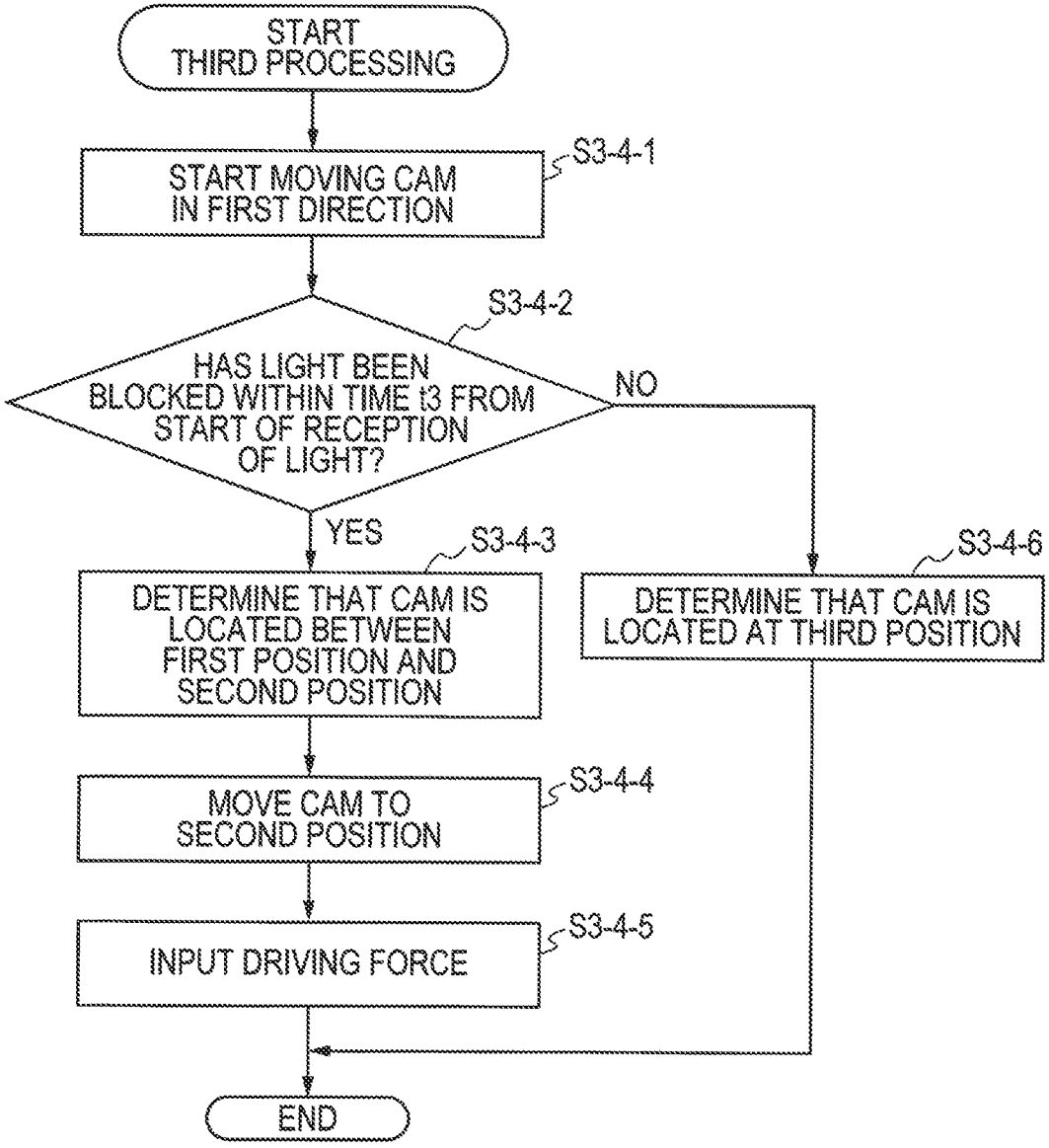
FIG. 21 is a flowchart for explaining third processing shown in FIG. 20.

As shown in FIG. 21, in the third processing, first, the first cam 11 is moved in the first direction at a particular speed by a particular distance (S3-4-1). The moving distance of the first cam 11 in the third processing is larger than or equal to the dimension of the light transmitting portion 1121 in the first direction, and is smaller than or equal to the sum of the dimension of the second rib 1123 and the dimension of the light transmitting portion 1121 in the first direction.

Specifically, the controller 10 switches the rotation direction of the motor 102 from the second rotation direction to the first rotation direction. The controller 10 switches the electromagnetic clutch 103 from the release state to the transmission state. As a result, the second cam 12 moves in the second direction, and the first cam 11 moves in the first direction at a particular speed.

Subsequently, the controller 10 determines whether the light receiving portion 62 has received the light L after the first cam 11 started moving and the light L from the light emitting portion 61 has been blocked within a third particular time t3 after the light receiving portion 62 starts receiving the light L (S3-4-2).

The third particular time t3 is the time in which the first cam 11 moves in the first direction at a particular speed by the same distance as the dimension of the light transmitting portion 1121.

Figure 23C:
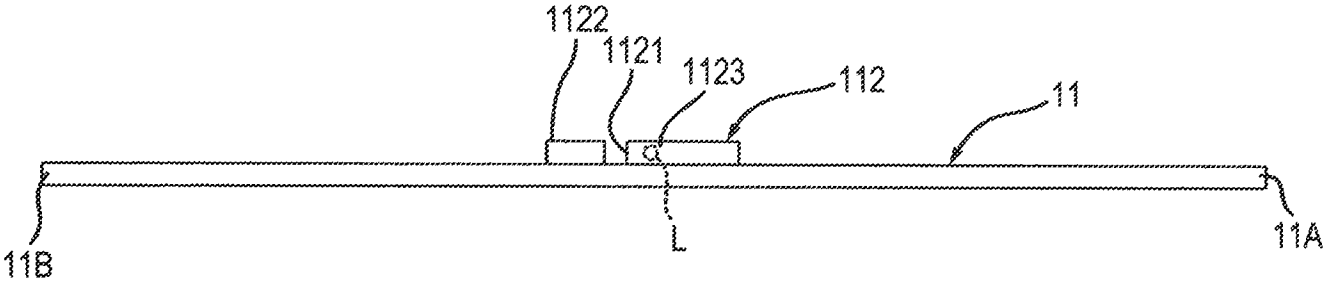
FIG. 23C shows a state where the first cam shown in FIG. 23B has moved in the first direction in the processing of S3-4-4 shown in FIG. 21.

As shown in FIGS. 23B and 23C, when the first cam 11 moves in the first direction at a particular speed, the light transmitting portion 1121 passes between the light emitting portion 61 and the light receiving portion 62. At this time, the light receiving portion 62 receives the light L from the light emitting portion 61 for the third particular time t3. After that, when the second rib 1123 reaches the position between the light emitting portion 61 and the light receiving portion 62, the light L from the light emitting portion 61 is blocked. That is, the light receiving portion 62 switches from the light receiving state to the light blocking state, and then switches from the light blocking state to the light receiving state. After that, the controller 10 switches the electromagnetic clutch 103 from the transmission state to the release state. As a result, the first cam 11 stops in a state where the second rib 1123 blocks the light L of the light emitting portion 61.

In this case, as shown in FIG. 21, the controller 10 determines that, when the first cam 11 is moved in the first direction in the third processing, the light L of the sensor 6 is blocked within a third particular time t3 after the light receiving portion 62 receives the light again (Yes in S3-4-2). Then, the controller 10 determines that the first cam 11 was between the first position and the second position during the initial operation (S3-4-3).

In response to determining that the first cam 11 is between the first position and the second position, the controller 10 moves the first cam 11 to the second position (S3-4-4).

Subsequently, in response to determining that the first cam 11 is located at the first position or between the first position and the second position during the initial operation, the controller 10 inputs the driving force from the four second input portions 101Y, 101M, 101C, and 101K to the four development rollers 422Y, 422M, 422C, and 422K in a state where the first cam 11 is moved to the second position in the same manner as in S2-5 (S3-4-5).

Further, when the first cam 11 is moved in the first direction in the third processing, and the light receiving portion 62 receives the light L again for more than the particular time t3 after the light receiving portion 62 starts receiving the light L (No in S3-4-2), the controller 10 determines that the first cam 11 was in the third position during the initial operation (S3-4-6).

In this way, the second processing is completed.

After that, as shown in FIG. 18, the controller 10 executes the cam movement processing (S4). The controller 10 moves the first cam 11 to the third position. In other words, when it is determined that the first cam 11 is between the first position and the second position during the initial operation, the controller 10 inputs the driving force from the four second input portions 101Y, 101M, 101C, and 101K to the four development rollers 422Y, 422M, 422C, and 422K in a state where the first cam 11 is moved to the second position, and then moves the first cam 11 in the first direction so as to be located to the third position (see FIG. 21).

In this way, the operation of the image forming apparatus 1 is completed, and the first cam 11 is located at the third position.

6. Operations and Effects (1) In the image forming apparatus 1, the controller 10 detects which of the first position, the second position (or the fourth position), and the third position the first cam 11 is located at during the initial operation. Thus, the first cam 11 can be smoothly located at a desired position after the initial operation.

(2) The first cam 11 includes the light transmitting portion 1121 configured to transmit light from the light emitting portion 61. Thus, the light receiving portion 62 receives the light from the light emitting portion 61 that has passed through the light transmitting portion 1121. As a result, the sensor 6 detects which of the first position, the second position (or the fourth position), and the third position the first cam 11 is located at, based on whether the light receiving portion 62 has received light. As a result, the first cam 11 can be smoothly located at a desired position.

(3) When the development cartridge 42K is mounted on the drum frame 411K, the development cartridge 42K is sometimes mounted on the drum frame 411K in a state where the development cartridge 42K is offset toward the second side wall 4112.

In this case, when the cartridge 4K is mounted on the housing 2, the second contact portion 4212 of the development cartridge 42K may be located to be offset in the third direction with respect to the protrusion 183 of the arm 18K. Thus, when the first cam 11 moves from the second position to the third position, the protrusion 183 may not contact the second contact portion 4212, and the development cartridge 42K may not move stably from the contact position to the separation position.

On the other hand, in the image forming apparatus 1, when the controller 10 determines that the first cam 11 is located at the first position or between the first position and the second position during the initial operation, the controller 10 moves the first cam 11 to the second position. That is, if there is a possibility that the cartridge 4K has been taken out from the housing 2 before the initial operation of the image forming apparatus 1, the controller 10 moves the first cam 11 to the second position during the initial operation.

After that, in a state where the first cam 11 is located at the second position and the four development cartridges 42Y, 42M, 42C, and 42K are located at the contact positions, the controller 10 inputs the driving force from the four second input portions 101Y, 101M, 101C, and 101K to the four development rollers 422Y, 422M, 422C, and 422K, respectively (S2-5).

As a result, the development roller 422K rotates in a state where the development roller 422K is in contact with the photosensitive drum 412K. Then, the development cartridge 42K receives such a force that the development roller 42K approaches the first side wall 4111 of the drum cartridge 41K in the third direction. As a result, the second contact portion 4212 of the development cartridge 42K is arranged close to the first cam 11 in the third direction, and stably faces the protrusion 183 of the arm 18K in the first direction.

Similarly, in the three development cartridges 42Y, 42M, and 42C, the second contact portion 4212 is arranged close to the first cam 11 in the third direction, and stably faces the protrusion 183 in the first direction.

As a result, when the first cam 11 moves from the second position to the third position, the protrusion 183 is reliably brought into contact with the second portion 4212B of the second contact portion 4212, and the four development cartridges 42Y, 42M, 42C, and 42K are moved from the contact position to the separation position.

7. Modification

While the disclosure has been described in detail with reference to the above aspects thereof, it would be apparent to those skilled in the art that various changes and modifications may be made therein without departing from the scope of the claims.

For example, the cartridge 4 may be a process cartridge. In this case, the cartridge 4 includes a drum frame 411, a photosensitive drum 412, a charging device 413, a drum coupling 418, a development electrode 414, a rotating member 415, two pressing members 416 and 417, a development frame 421, a development roller 422, and a development coupling 423.

Further, in the above embodiment, after the controller 10 executes the determination processing (S1) and the first processing (S2) or the second processing (S3), the first cam 11 is located at the third position as the desired position. However, the first cam 11 may move to any of the first position, the second position, and the fourth position after the completion of the first processing (S2) or the second processing (S3).

In these modifications, the operations and effects similar to those of the above-described embodiment can be obtained.

What is claimed is:

1. An image forming apparatus comprising:

a housing having an opening;

a first cartridge attachable to and detachable from the housing through the opening, the first cartridge including a first photosensitive drum and a first development roller;

a second cartridge attachable to and detachable from the housing through the opening, the second cartridge including a second photosensitive drum and a second development roller;

a sensor including a light emitting portion and a light receiving portion, the light receiving portion being configured to receive light from the light emitting portion, the sensor being configured to detect reception of light by the light receiving portion;

a cam configured to transmit and block light emitted from the light emitting portion, the cam being movable to:

a first position at which the first cartridge and the second cartridge are attachable to and detachable from the housing;

a second position at which the first development roller contacts the first photosensitive drum, the second position being a position at which the cam has moved in a first direction from the first position; and a third position at which the first development roller is separated from the first photosensitive drum and the second development roller is separated from the second photosensitive drum, the third position being a position at which the cam has moved in the first direction from the second position; and a controller configured to, during an initial operation, based on a detection result of the sensor, determine which of the first position, the second position, and the third position the cam is located at.

2. The image forming apparatus according to claim 1, wherein the controller is configured to:

when light of the sensor is blocked during the initial operation, perform first processing of moving the cam in the first direction; and when the light receiving portion receives light after the cam starts moving and light of the sensor is blocked within a particular time after the light receiving portion starts receiving light, determine that the cam is located at the first position during the initial operation.

3. The image forming apparatus according to claim 2, wherein the controller is configured to, in response to determining that the cam is located at the first position, control the cam to move to the second position.

4. The image forming apparatus according to claim 2, wherein the controller is configured to, in response to determining that the cam is located at the second position, control the cam to move to the third position.

5. The image forming apparatus according to claim 1, wherein the controller is configured to:

when light of the sensor is blocked during the initial operation, perform first processing of moving the cam in the first direction; and when the light receiving portion receives light after the cam starts moving and the light receiving portion continues receiving light for more than a particular time after the light receiving portion starts receiving light, determine that the cam is located at the second position during the initial operation.

6. The image forming apparatus according to claim 1, wherein the controller is configured to:

when light from the light emitting portion is received by the light receiving portion, perform second processing of moving the cam in a second direction which is opposite the first direction; and when the light receiving portion continues receiving light for more than a particular time after the cam starts moving, determine that the cam is located at the third position during the initial operation.

7. The image forming apparatus according to claim 6, wherein the controller is configured to, in response to determining that the cam is located at the third position, control the cam, which has moved in the second direction, to move in the first direction again to the third position.

8. The image forming apparatus according to claim 1, wherein the controller is configured to:

when light from the light emitting portion is received by the light receiving portion, perform second processing of moving the cam in a second direction which is opposite the first direction; and in response to determining that light of the sensor is blocked within a particular time after the cam starts moving and that the cam is then moved in the first direction and light is blocked within a particular time after the light receiving portion receives light again, determine that the cam is located between the first position and the second position during the initial operation.

9. The image forming apparatus according to claim 8, wherein the controller is configured to, in response to determining that the cam is located between the first position and the second position, control the cam to move to the second position.

10. The image forming apparatus according to claim 1, further comprising an input portion configured to input a driving force to the first development roller and the second development roller, wherein the controller is configured to, in response to determining that the cam is located at the first position or between the first position and the second position during the initial operation, input a driving force from the input portion to the first development roller and the second development roller in a state where the cam has moved to the second position, and then move the cam to the third position.

11. The image forming apparatus according to claim 1, wherein the cam has one end and an other end in the first direction; and wherein the cam includes a light transmitting portion configured to transmit light of the light emitting portion, the light transmitting portion being located between the one end and the other end in the first direction.

12. The image forming apparatus according to claim 11, wherein the light transmitting portion is a slit.

13. The image forming apparatus according to claim 12, wherein, when the cam is located at the first position, the slit is closer to the one end than the sensor is.

14. The image forming apparatus according to claim 12, wherein, when the cam is located at the second position, the slit is closer to the other end than the sensor is.

15. The image forming apparatus according to claim 12, wherein, when the cam is located at the third position, a rib formed with the slit is closer to the other end than the sensor is.

16. The image forming apparatus according to claim 1, wherein the first cartridge includes:

a drum cartridge including the first photosensitive drum; and a development cartridge including the first development roller; and wherein the development cartridge is attachable to and detachable from the drum cartridge.

17. The image forming apparatus according to claim 1, further comprising a cover configured to open and close the opening, wherein the initial operation is performed when the cover is opened and then closed or when a power of the image forming apparatus is turned on.

18. An image forming apparatus comprising:

a housing having an opening;

a first cartridge attachable to and detachable from the housing through the opening, the first cartridge including a first photosensitive drum and a first development roller;

a second cartridge attachable to and detachable from the housing through the opening, the second cartridge including a second photosensitive drum and a second development roller;

a sensor including a light emitting portion and a light receiving portion, the light receiving portion being configured to receive light from the light emitting portion, the sensor being configured to detect reception of light by the light receiving portion; and a cam configured to transmit and block light emitted from the light emitting portion, the cam being movable to:

a first position at which the first cartridge and the second cartridge are attachable to and detachable from the housing;

a second position at which the first development roller contacts the first photosensitive drum, the second position being a position at which the cam has moved in a first direction from the first position; and a third position at which the first development roller is separated from the first photosensitive drum and the second development roller is separated from the second photosensitive drum, the third position being a position at which the cam has moved in the first direction from the second position, the cam having one end and an other end in a movement direction of the cam, the cam including a light transmitting portion configured to transmit light emitted from the light emitting portion, the light transmitting portion being located between the one end and the other end in the movement direction.

* * * * *